US009773458B2

(12) United States Patent
Sugimoto

(10) Patent No.: US 9,773,458 B2
(45) Date of Patent: Sep. 26, 2017

(54) DISPLAY APPARATUS AND CONTROL METHOD THEREOF

(71) Applicant: CANON KABUSHIKI KAISHA, Tokyo (JP)

(72) Inventor: Kousei Sugimoto, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 489 days.

(21) Appl. No.: 14/605,531

(22) Filed: Jan. 26, 2015

(65) Prior Publication Data

US 2015/0213766 A1 Jul. 30, 2015

(30) Foreign Application Priority Data

Jan. 29, 2014 (JP) ..... 2014-014516

(51) Int. Cl.

*G09G 3/34* (2006.01)
*G09G 3/20* (2006.01)
*G09G 3/36* (2006.01)

(52) U.S. Cl.

CPC ..... *G09G 3/3406* (2013.01); *G09G 3/2096* (2013.01); *G09G 3/36* (2013.01); *G09G 2320/0646* (2013.01); *G09G 2340/0428* (2013.01); *G09G 2340/06* (2013.01); *G09G 2360/16* (2013.01)

(58) Field of Classification Search

CPC ..... G09G 3/3406; G09G 2320/0646; G09G 2340/0428; G09G 2340/06; G09G 2340/16
USPC ..... 345/102, 690–697
See application file for complete search history.

(56) References Cited

U.S. PATENT DOCUMENTS

2012/0262600 A1 10/2012 Velarde et al.
2012/0306943 A1 12/2012 Messmer
2013/0100178 A1 4/2013 Ninan et al.

FOREIGN PATENT DOCUMENTS

JP 2002-099250 A 4/2002
JP 2005-284534 A 10/2005
JP 2007-121375 A 5/2007
JP 2011-193511 A 9/2011

OTHER PUBLICATIONS

The above US Publications were cited in the Nov. 1, 2016 Japanese Office Action, which is enclosed without an English Translation, that issued in Japanese Patent Application No. 2016-011388.
The above foreign patent documents were cited in the Sep. 8, 2015 Japanese Office Action, which is enclosed without an English Translation, that issued in Japanese Patent Application No. 2014-014516.

*Primary Examiner* — Michael Pervan
(74) *Attorney, Agent, or Firm* — Cowan, Liebowitz & Latman, P.C.

(57) ABSTRACT

A display apparatus according to the present invention includes: a light emission unit; a display unit configured to display an image on a screen by modulating light from the light emission unit; an acquisition unit configured to acquire base image data and difference data used in an expansion process for expanding at least one of a dynamic range and a color gamut of image data; a control unit configured to control light emission of the light emission unit, based on the difference data; and a generation unit configured to generate display image data outputted to the display unit, based on the base image data.

25 Claims, 11 Drawing Sheets

DISPLAY APPARATUS AND CONTROL METHOD THEREOF

BACKGROUND OF THE INVENTION

Field of the Invention

The present invention relates to a display apparatus and a control method thereof.

Description of the Related Art

In recent years, a high dynamic range (HDR) display that allows a lifelike display image (an image displayed on a screen) by using multi-bit image data is performed.

As one of methods for recording HDR image data (multi-bit image data) having a wide dynamic range and a wide color gamut, there is a method in which the HDR image data is divided into base image data and difference data, and the base image data and the difference data are recorded (Japanese Patent Application Laid-open No. 2011-193511). That is, as one of data formats of the HDR image data, there is a format that uses the base image data and the difference data. The base image data is low-bit image data obtained by performing gradation compression on the HDR image data. The difference data is, e.g., data representing a difference in brightness value (gradation value) between the base image data and the HDR image data.

When such a data format is used, it becomes possible to perform image display in both of a display apparatus that can execute the HDR display and a display apparatus that cannot execute the HDR display. Specifically, in the display apparatus that can execute the HDR display, it is possible to restore the HDR image data from the base image data and the difference data and display the HDR image data. In the display apparatus that cannot execute the HDR display, it is possible to display the base image data.

In addition, when the above-described data format is used, it is possible to reduce a signal band between an output apparatus (an apparatus that outputs image data) and the display apparatus. Specifically, there is proposed a technology in which the output apparatus outputs the base image data and the difference data, and the display apparatus restores the HDR image data from the base image data and the difference data (Japanese Patent Application Laid-open No. 2007-121375). By dividing the HDR image data into the base image and difference information and outputting the base image and the difference information, it is possible to reduce the signal band as compared with the case where the HDR image data is outputted.

However, in a conventional display apparatus, multi-bit HDR image data is processed in order to obtain a display image having a wide dynamic range and a wide color gamut. Accordingly, a processing load and a circuit size are increased.

SUMMARY OF THE INVENTION

The present invention provides a technology capable of obtaining the display image having the wide dynamic range and the wide color gamut with the small processing load.

The present invention in its first aspect provides a display apparatus comprising:

a light emission unit;

a display unit configured to display an image on a screen by modulating light from the light emission unit;

an acquisition unit configured to acquire base image data and difference data used in an expansion process for expanding at least one of a dynamic range and a color gamut of image data;

a control unit configured to control light emission of the light emission unit, based on the difference data; and a generation unit configured to generate display image data outputted to the display unit, based on the base image data.

The present invention in its second aspect provides a display apparatus comprising:

a light emission unit;

a display unit configured to display an image on a screen by modulating light from the light emission unit;

an acquisition unit configured to acquire base image data and difference data used in an expansion process for expanding at least one of a dynamic range and a color gamut of image data;

an expansion unit configured to generate HDR image data by performing the expansion process using the difference data on the base image data;

a reduction unit configured to generate limited HDR image data by reducing a dynamic range of the HDR image data such that the dynamic range of the HDR image data matches a dynamic range that can be taken by the image displayed on the screen;

a control unit configured to control light emission of the light emission unit, based on the limited HDR image data; and a correction unit configured to generate display image data outputted to the display unit by correcting a gradation value of the limited HDR image data, based on a difference between the light emission based on the limited HDR image data and reference light emission.

The present invention in its third aspect provides a control method of a display apparatus having light emission unit and display unit configured to display an image on a screen by modulating light from the light emission unit, the method comprising:

acquiring base image data and difference data used in an expansion process for expanding at least one of a dynamic range and a color gamut of image data;

controlling light emission of the light emission unit based on the difference data; and generating display image data outputted to the display unit based on the base image data.

The present invention in its fourth aspect provides a control method of a display apparatus having light emission unit and display unit configured to display an image on a screen by modulating light from the light emission unit, the method comprising:

acquiring base image data and difference data used in an expansion process for expanding at least one of a dynamic range and a color gamut of image data;

generating HDR image data by performing the expansion process using the difference data on the base image data;

generating limited HDR image data by reducing a dynamic range of the HDR image data such that the dynamic range of the HDR image data matches a dynamic range that can be taken by the image displayed on the screen;

controlling light emission of the light emission unit based on the limited HDR image data; and generating display image data outputted to the display unit by correcting a gradation value of the limited HDR image data, based on a difference between the light emission based on the limited HDR image data and reference light emission.

The present invention in its fifth aspect provides a non-transitory computer readable medium that stores a program, wherein the program causes a computer to execute the method.

According to the present invention, it is possible to obtain the display image having the wide dynamic range and the wide color gamut with the small processing load.

Further features of the present invention will become apparent from the following description of exemplary embodiments with reference to the attached drawings.

DESCRIPTION OF THE EMBODIMENTS

First Embodiment

Hereinbelow, a description will be given of a display apparatus and a control method thereof according to a first embodiment of the present invention.

Note that an example in which the display apparatus according to the pre sent embodiment is a transmissive liquid crystal display apparatus will be described hereinbelow, but the display apparatus according to the present embodiment is not limited thereto. The display apparatus according to the present embodiment may be any display apparatus as long as the display apparatus displays an image on a screen by modulating light from a light emission unit. For example, the display apparatus according to the present embodiment may be a reflective liquid crystal display apparatus. Alternatively, the display apparatus according to the present embodiment may also be an MEMS shutter display that uses a micro electromechanical system (MEMS) shutter instead of a liquid crystal element.

Figure 1:
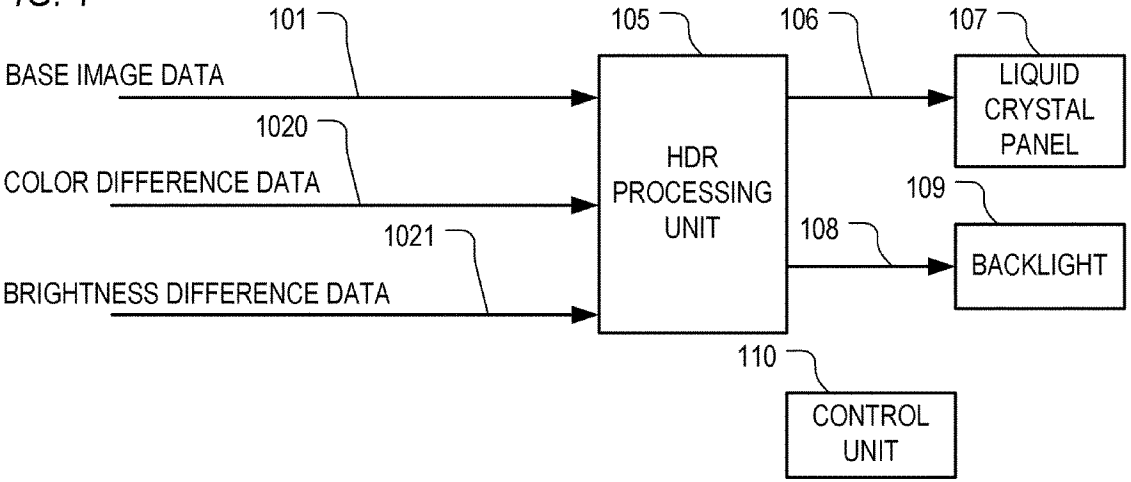
FIG. 1 is a block diagram showing an example of the functional configuration of a display apparatus according to a first embodiment.

FIG. 1 is a block diagram showing an example of the functional configuration of the display apparatus according to the present embodiment.

To the display apparatus according to the present embodiment, base image data 101 and difference data are inputted. Specifically, as the difference data, color difference data 1020 and brightness difference data 1021 are inputted.

The base image data 101 (first base image data) is low-bit image data obtained by performing gradation compression on HDR image data (multi-bit image data) having a wide dynamic range and a wide color gamut by a bit conversion process. In the present embodiment, the base image data is RGB image data of which an R value, a G value, and a B value are 8-bit values. In addition, in the present embodiment, the HDR image data is RGB image data of which the R value, the G value, and the B value are 32-bit values.

The difference data is data used in an expansion process for expanding at least one of the dynamic range and the color gamut of the image data.

Specifically, the color difference data 1020 is data used in a color gamut expansion process for expanding the color gamut of the image data, and is data representing a difference in color between the HDR image data and the base image data. For example, the color difference data is data representing a color difference value as a difference value obtained by subtracting one of the chrominance value of the base image data (Cb value, Cr value) and the chrominance value of the HDR image data (Cb value, Cr value) from the other one thereof on a per-pixel basis (or on a per-area consisting of the predetermined number of pixels basis). However, the color difference data may also be color ratio data representing a color ratio as a ratio between the chrominance value of the base image data (Cb value, Cr value) and the chrominance value of the HDR image data (Cb value, Cr value) on a per-pixel basis (or on a per-area consisting of the predetermined number of pixels basis). In addition, the color difference value or the color ratio may also be a value calculated by using the R value, the G value, and the B value instead of the chrominance value. Note that the color gamut expansion process can be regarded as a process for reproducing colors that cannot be expressed using the base image data. In the present embodiment, as the color difference data 1020, a Cb difference value and a Cr difference value of each pixel are inputted. In addition, in the present embodiment, each of the Cb difference value and the Cr difference value is expressed in the form of an 8-bit floating point. The Cb difference value is a value obtained by subtracting one of the Cb value of the base image data 101 and the Cb value of the HDR image data from the other one thereof, and the Cr difference value is a value obtained by subtracting one of the Cr value of the base image data 101 and the Cr value of the HDR image data from the other one thereof.

The brightness difference data 1021 (first difference data) is data used in a brightness range expansion process for expanding the dynamic range of the image data, and is data representing a difference in brightness value between the HDR image data and the base image data. For example, the brightness difference data is brightness ratio data representing a brightness ratio as a ratio between the brightness value (gradation value) of the base image data and the brightness value (gradation value) of the HDR image data on a per-pixel basis (or on a per-area consisting of the predetermined number of pixels basis). That is, the brightness difference data is brightness ratio data representing a ratio or a reciprocal of the ratio of the brightness value (gradation value) of the HDR image data to the brightness value (gradation value) of the base image data on a per-pixel basis (or on a per-area consisting of the predetermined number of pixels basis). However, the brightness difference data may also be data representing a brightness difference value as a difference value obtained by subtracting one of the brightness value (gradation value) of the base image data and the brightness value (gradation value) of the HDR image data from the other one thereof on a per-pixel basis (or on a per-area consisting of the predetermined number of pixels basis). In addition, the brightness difference data may also be brightness conversion table data (e.g., an inverse tone map described later) representing a correspondence between an input brightness value and an output brightness value in the brightness range expansion process. Note that the brightness range expansion process can be regarded as a process for reproducing the brightness that cannot be expressed using the base image data. In the present embodiment, as the brightness difference data 1021, the brightness ratio data representing the brightness ratio as the ratio between the brightness value (gradation value) of the base image data and the brightness value (gradation value) of the HDR image data on a per-pixel basis (or on a per-area consisting of the predetermined number of pixels basis) is inputted. In addition, in the present embodiment, the brightness ratio is expressed in the form of the 8-bit floating point. The gradation value includes a pixel value, the brightness value, and the like.

Note that the number of bits of each of the HDR image data, the base image data 101, the color difference data 1020, and the brightness difference data 1021 is not particularly limited.

Note that at least one of the color difference data 1020 and the brightness difference data 1021 may not be inputted. For example, in the case where the HDR image data is subjected to gradation compression, the brightness value is changed, but there are cases where the color is not changed. That is, there are cases where the color of the HDR image data matches the color of the base image data 101. In such cases, the color difference data 1020 becomes unnecessary. In addition, in the case where the base image data 101 is image data in which the color gamut of the HDR image data is compressed, there are cases where the brightness value of the HDR image data matches the brightness value of the base image data 101. In such cases, the brightness difference data 1021 becomes unnecessary.

A relationship among the pixel value of the HDR image data corresponding to original image data, the pixel value of the base image data 101, the value of the color difference data 1020, and the value of the brightness difference data 1021 is represented by the following Expression 1. In Expression 1, (Ro, Go, Bo) is the pixel value of the HDR image data, and (R, G, B) is the pixel value of the base image data 101. ResCb is the Cb difference value represented by the color difference data 1020, ResCr is the Cr difference value represented by the color difference data 1020, and Ra is the brightness ratio represented by the brightness difference data 1021. M is a conversion matrix for converting RGB values to YCbCr values, and $M^{-1}$ (an inverse matrix of the matrix M) is a conversion matrix for converting the YCbCr values to the RGB values.

[Expression 1]

$$\begin{pmatrix} Ro \\ Go \\ Bo \end{pmatrix} = M^{-1}\left(M\begin{pmatrix} R \\ G \\ B \end{pmatrix} + \begin{pmatrix} 0 \\ ResCb \\ ResCr \end{pmatrix}\right) \times Ra \quad \text{(Expression 1)}$$

An HDR processing unit 105 acquires the base image data 101, the color difference data 1020, and the brightness difference data 1021, and generates display image data 106 and a backlight control value 108 based on the acquired information items. Subsequently, the HDR processing unit 105 outputs the display image data 106 to a liquid crystal panel 107, and outputs the backlight control value 108 to a backlight 109. The display image data is image data that is used in the display in the liquid crystal panel 107. The backlight control value 108 corresponds to a light emission brightness of the backlight 109. Hereinafter, the brightness of light emitted from the backlight 109 is described as the "light emission brightness".

The liquid crystal panel 107 has, for example, a plurality of liquid crystal elements, a liquid crystal driver, and a control board. The control board controls the liquid crystal driver, and the liquid crystal driver drives each liquid crystal element. In the present embodiment, the transmittance of each liquid crystal element is controlled based on the display image data 106. Specifically, the control board outputs a control signal corresponding to the display image data 106 to the liquid crystal driver, and the liquid crystal driver drives each liquid crystal element in correspondence to the control signal from the control board. Light from the backlight 109 passes through each liquid crystal element, and the image (display image) is thereby displayed on a screen.

The backlight 109 is a light emission unit that emits light to the back surface of the liquid crystal panel 107. The backlight 109 has, for example, a light source, a drive circuit that drives the light source, and an optical unit that diffuses light from the light source. In the present embodiment, the backlight 109 emits light at the light emission brightness corresponding to the backlight control value 108. Specifically, the drive circuit drives the light source such that the light source emits light at the light emission brightness corresponding to the backlight control value. In addition, in the present embodiment, the backlight 109 is configured to be capable of controlling the light emission brightness on the basis of units of light-emitting areas each constituted of a plurality of pixels basis. Specifically, the backlight 109 is configured to be capable of individually controlling the light emission brightness of each of a plurality of the light-emitting areas constituting an area of the screen. For example, the backlight 109 has the light source for each light-emitting area. The light source has one or more light-emitting devices. As the light-emitting device, a light-emitting diode (LED), an organic EL device, and a cold-cathode tube can be used.

Note that, in the present embodiment, an example in which the area of the screen is configured by a plurality of the light-emitting areas will be described, but the area of the screen may also be configured by one light-emitting area.

A control unit 110 controls the operation and its timing of each functional unit through control lines (not shown).

In the present embodiment, in the case where the original image data (the HDR image data) is still image data, the base image data and the difference data corresponding to one still image data item are present. In the case where the original image data is moving image data, the base image data and the difference data are present for each frame. In the present embodiment, irrespective of that the original image data is the still image data or the moving image data, the base image data and the difference data are inputted to the display apparatus for each frame. In the case of such a configuration, the commonality of internal processing (internal processing of the display apparatus) in the case where the original image data is the still image data and the case where the original image data is the moving image data can be achieved.

Herein, in the case where the original image data is the moving image data, from the viewpoint of image quality, it is preferable to calculate the backlight control value 108 for each frame. However, in the case where the original image data is the still image data, from the viewpoint of the image quality and a computation amount, it is preferable to calculate the backlight control value 108 only once instead of calculating the backlight control value 108 for each frame. By limiting the number of calculations of the backlight control value 108 to one, it is possible to reduce the computation amount as compared with the case where the backlight control value 108 is calculated for each frame. In addition, it is possible to suppress fluctuation of the backlight control value 108 caused by a noise or the like in spite of that the base image data or the difference data is not changed.

In the case where the base image data 101, the color difference data 1020, and the brightness difference data 1021 are information items of the still image data, the control unit 110 controls the HDR processing unit 105 such that the backlight control value 108 is calculated and outputted only once. Specifically, the control unit 110 controls the HDR processing unit 105 such that the backlight control value 108 is calculated and outputted only for the first frame of the still image data. With this, a process for controlling the light emission brightness is performed for the first frame of the still image data, and the process for controlling the light emission brightness is omitted for the second and subsequent frames of the still image data.

In addition, in the case where the base image data 101, the color difference data 1020, and the brightness difference data 1021 are information items of the moving image data, the control unit 110 controls the HDR processing unit 105 such that the backlight control value 108 is calculated for each frame. With this, the process for controlling the light emission brightness is performed for each frame of the moving image data.

Note that the process for controlling the light emission brightness for each frame may also be performed irrespective of that the original image data is the still image data or the moving image data.

Figure 2:
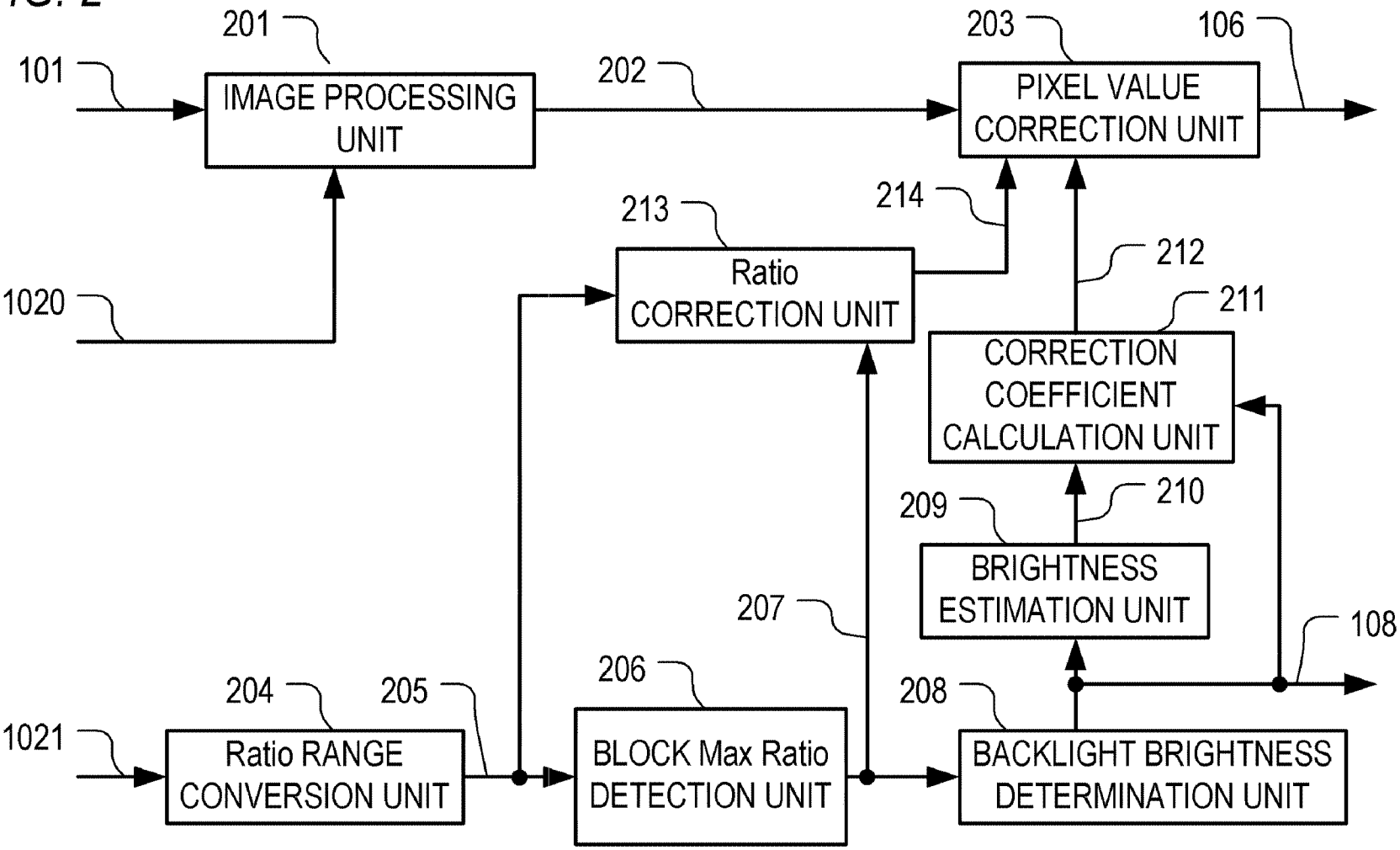
FIG. 2 is a block diagram showing an example of the functional configuration of an HDR processing unit according to the first embodiment.

FIG. 2 is a block diagram showing an example of the functional configuration of the HDR processing unit 105.

An image processing unit 201 acquires the base image data 101 and the color difference data 1020. Subsequently, the image processing unit 201 generates processed base image data 202 (second base image data) by performing a predetermined image process on the base image data 101. In the present embodiment, the predetermined image process includes the color gamut expansion process that uses the color difference data 1020. In the present embodiment, the predetermined image process is performed not on the multi-bit HDR image data but on the low-bit base image data. With this, it is possible to reduce the processing load and the circuit scale of the image processing unit 201 as compared with the case where the predetermined image process is performed on the multi-bit HDR image data.

In the present embodiment, the pixel value after the color gamut expansion process is calculated by using the following Expression 2. In Expression 2, (Rc, Gc, Bc) is the pixel value after the color gamut expansion process.

[Expression 2]

$$\begin{pmatrix} Rc \\ Gc \\ Bc \end{pmatrix} = M^{-1}\left(M\begin{pmatrix} R \\ G \\ B \end{pmatrix} + \begin{pmatrix} 0 \\ ResCb \\ ResCr \end{pmatrix}\right) \quad \text{(Expression 2)}$$

Note that a plurality of image processes may be executed as the predetermined image process. For example, the predetermined image process may include a luminosity adjustment process, a contract adjustment process, a chroma adjustment process, and a sharpness adjustment process. The predetermined image process may not include the color gamut expansion process described above.

A Ratio range conversion unit 204 acquires the brightness difference data 1021. Subsequently, the Ratio range conversion unit 204 generates converted difference data 205 (second difference data) that is smaller in the expansion degree of the dynamic range than the brightness difference data 1021 by correcting the brightness difference data 1021.

In order to obtain the lifelike display image (the image displayed on the screen), it is preferable to be capable of display having a display brightness (the brightness on the screen) of about 10000 cd/m$^2$. However, the maximum value of the dynamic range that can be taken by the display image is not necessarily wide, and the display having the display brightness of about 10000 cd/m$^2$ is not necessarily possible. Specifically, the upper limit value of the brightness of the display image corresponds to the upper limit value of the light emission brightness of the backlight 109 (or a value slightly lower than the upper limit value of the light emission brightness of the backlight 109), but the backlight 109 is not necessarily capable of emitting light at the light emission brightness of about 10000 cd/m$^2$.

To cope with this, the Ratio range conversion unit 204 corrects the brightness difference data 1021 such that the dynamic range of the image data after the brightness range expansion process that uses the converted difference data 205 matches the dynamic range that can be taken by the display image. In the present embodiment, the brightness difference data 1021 is corrected such that the dynamic range of the image data after the brightness range expansion process that uses the converted difference data 205 matches the maximum value of the dynamic range that can be taken by the display image.

In the present embodiment, the brightness difference data 1021 is converted to the converted difference data 205 by using a conversion lookup table. The conversion lookup table represents a correspondence between a pre-conversion brightness ratio as the brightness ratio before the conversion (correction) and a post-conversion brightness ratio as the brightness ratio after the conversion.

Figure 3:
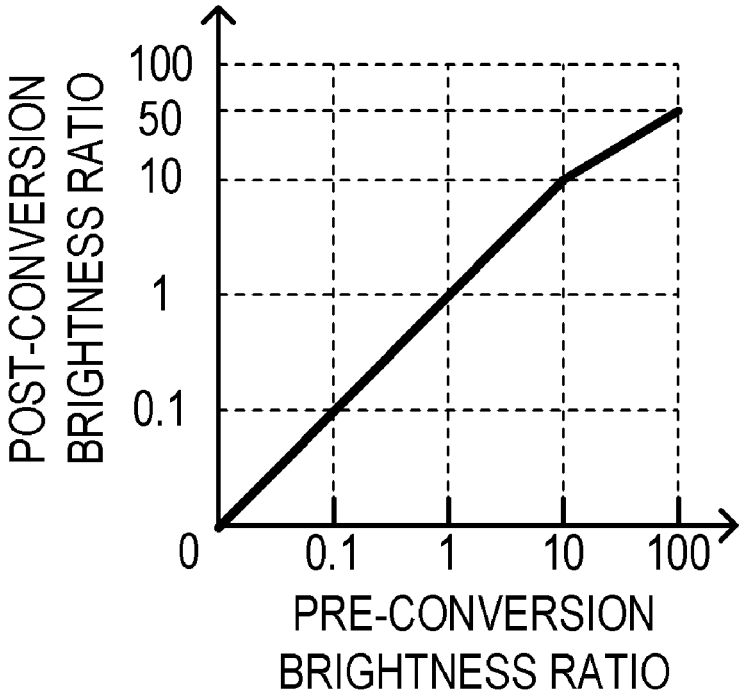
FIG. 3 is a view showing an example of a table for correcting a brightness ratio.

FIG. 3 shows an example of the conversion lookup table. The horizontal axis of FIG. 3 indicates the pre-conversion brightness ratio, and the vertical axis thereof indicates the post-conversion brightness ratio. FIG. 3 shows an example of the case where the upper limit value of the display brightness is 5000 cd/m$^2$.

In the present embodiment, the backlight control value is generated based on the brightness ratio. Specifically, when the brightness ratio is high, the backlight control value corresponding to the light emission brightness higher than that when the brightness ratio is low is generated. For example, in the case of the brightness ratio=1 time, the backlight control value corresponding to the light emission brightness=100 cd/m$^2$ is generated and, in the case of the brightness ratio=50 times, the backlight control value corresponding to the light emission brightness=5000 cd/m$^2$ is generated.

As described above, the upper limit value of the display brightness is 5000 cd/m$^2$. Accordingly, in the example of FIG. 3, the upper limit of the post-conversion brightness ratio is limited to 50.

In addition, the brightness difference data 1021 typically includes many pre-conversion brightness ratios in the vicinity of 1 time. Accordingly, in the example of FIG. 3, in the vicinity of the pre-conversion brightness ratio=1 time, the same value as that of the pre-conversion brightness ratio is set as the value of the post-conversion brightness ratio.

In a high brightness range, it is difficult to perceive a difference in luminosity. Accordingly, in the example of FIG. 3, the range of the pre-conversion brightness ratio=10 times (1000 cd/m$^2$) to 100 times (10000 cd/m$^2$) is compressed to the range of the post-conversion brightness ratio=10 times to 50 times.

Further, in the example of FIG. 3, in the range of the pre-conversion brightness ratio=10 times to 100 times, the post-conversion brightness ratio is set so as not to become constant with respect to the increase of the pre-conversion brightness ratio. Specifically, in the range of the pre-conversion brightness ratio=10 times to 100 times, the post-conversion brightness ratio is set so as to increase with respect to the increase of the pre-conversion brightness ratio. With this, it is possible to prevent blown-out highlights.

Note that the brightness difference data 1021 may also be converted to the converted difference data 205 by using a function that represents the correspondence between the pre-conversion brightness ratio and the post-conversion brightness ratio. That is, the brightness ratio represented by the converted difference data 205 may be calculated by using the function.

Note that, in the present embodiment, the description has been given of the example in which the brightness difference data 1021 is corrected such that the dynamic range of the image data after the brightness range expansion process that uses the converted difference data 205 matches the maximum value of the dynamic range that can be taken by the display image, but the present invention is not limited thereto. The dynamic range of the image data after the brightness range expansion process that uses the converted difference data 205 may appropriately match the dynamic range that can be taken by the display image. The dynamic range of the image data after the brightness range expansion process that uses the converted difference data 205 may also match a value lower than the maximum value of the dynamic range that can be taken by the display image.

The light emission brightness of the backlight 109 is controlled based on the converted difference data 205 by a block Max Ratio detection unit 206 and a backlight brightness determination unit 208.

The block Max Ratio detection unit 206 acquires the characteristic value of the converted difference data 205 in the light-emitting area as a first characteristic value. In the present embodiment, the representative value of the post-conversion brightness ratio in the light-emitting area is acquired as the first characteristic value. Specifically, from among a plurality of the post-conversion brightness ratios in the light-emitting area, the post-conversion brightness ratio having the largest value (a block Max Ratio 207) is acquired as the first characteristic value. In the present embodiment, since a plurality of the light-emitting areas are present, the first characteristic value is acquired for each light-emitting area.

Note that the first characteristic value is not limited to the block Max Ratio 207. For example, the minimum value, the mode, the intermediate value, and the mean value of the post-conversion brightness ratio may be acquired as the first characteristic value.

Figure 4:
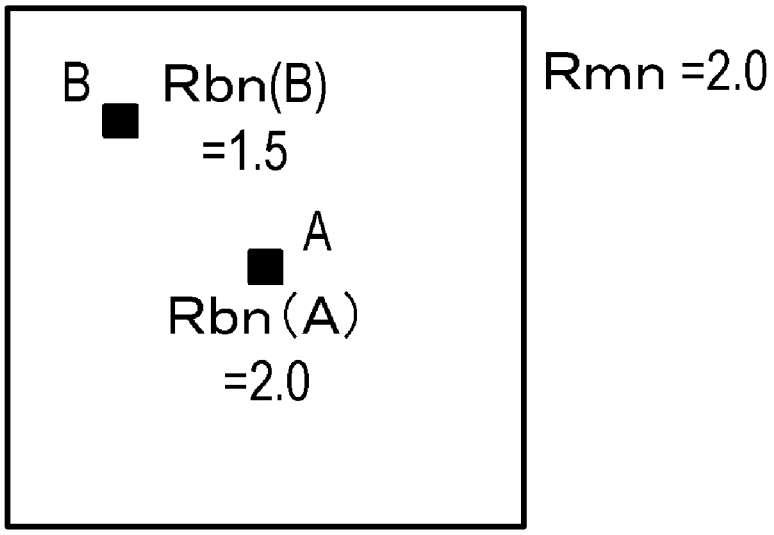
FIG. 4 is a view showing an example of a process of a block Max Ratio detection unit.

A specific example of the process of the block Max Ratio detection unit 206 will be described by using FIG. 4. In FIG. 4, an area surrounded by a solid line is the light-emitting area. A post-conversion brightness ratio Rbn (A) of a pixel A is 2.0 times, and a post-conversion brightness ratio Rbn (B) of a pixel B is 1.5 times. The post-conversion brightness ratios of pixels other than the pixels A and B are not shown in the drawing, and they are lower than 2.0 times. That is, in the example of FIG. 4, the post-conversion brightness ratio Rbn (A)=2.0 is the largest value. In this case, the post-conversion brightness ratio Rbn (A)=2.0 is detected as Rmn as the block Max Ratio.

The backlight brightness determination unit 208 controls the light emission brightness in the light-emitting area in accordance with the block Max Ratio 207. Specifically, the backlight brightness determination unit 208 determines the backlight control value 108 in accordance with the block Max Ratio 207, and outputs the determined backlight control value 108. With this, the light emission brightness is controlled. In the present embodiment, the backlight brightness determination unit 208 acquires the light emission brightness corresponding to the block Max Ratio 207 from a lookup table that represents a correspondence between the brightness ratio and the light emission brightness, and determines the backlight control value 108 corresponding to the acquired light emission brightness. In the present embodiment, since a plurality of the light-emitting areas are present, the backlight control value 108 is determined for each light-emitting area. That is, the light emission brightness is controlled for each light-emitting area.

Note that the light emission brightness corresponding to the block Max Ratio 207 may be calculated by using a function that represents the correspondence between the brightness ratio and the light emission brightness, and the backlight control value 108 corresponding to the calculated light emission brightness may be determined. In addition, the backlight control value 108 corresponding to the block Max Ratio 207 may also be acquired by using a table or a function that represents a correspondence between the brightness ratio and the backlight control value.

Figure 5:
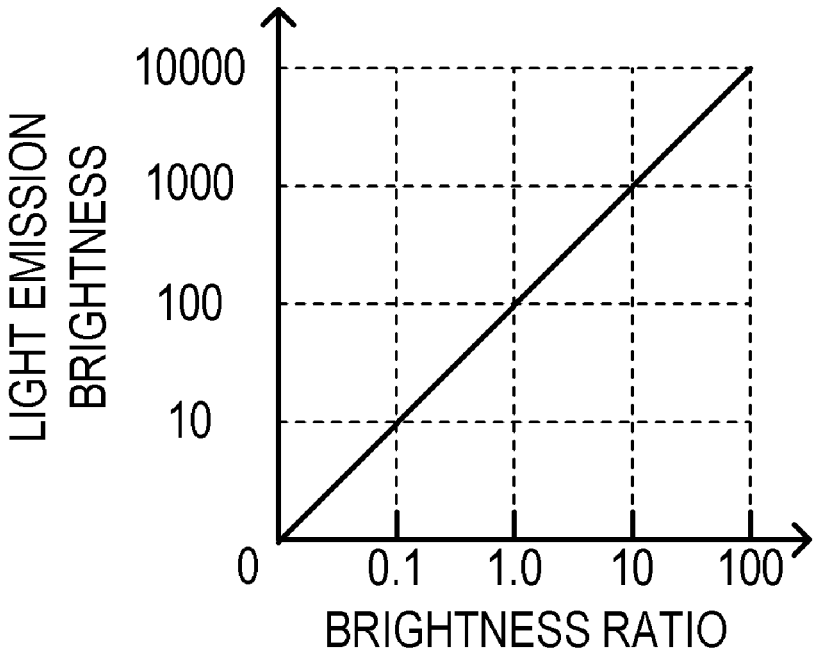
FIG. 5 is a view showing an example of a table for determining a backlight control value.

FIG. 5 shows an example of the lookup table that is used in the determination of the backlight control value 108. The horizontal axis of FIG. 5 indicates the brightness ratio, and the vertical axis thereof indicates the light emission brightness.

In the example of FIG. 5, the backlight control value 108 indicative of a higher light emission brightness is determined as the block Max Ratio 207 is larger.

A brightness estimation unit 209 estimates the brightness (an arrival brightness 210) of light emitted from the backlight 109 at the back surface of the liquid crystal panel 107 based on the backlight control value 108. In the present embodiment, it is assumed that the central position of the light-emitting area is set as the position (estimation position) for estimating the arrival brightness. In addition, in the present embodiment, since a plurality of the light-emitting areas are present, the arrival brightness 210 is estimated for each light-emitting area. The arrival brightness 210 is estimated in consideration of attenuation of light emitted from the light source, leakage of light from other light-emitting areas, and the like. In the present embodiment, arrival rate information is prepared for each light-emitting area. The arrival rate information represents the arrival rate of light emitted from the light source for each light source. An estimation process (a process for estimating the arrival brightness 210) is performed for each light-emitting area by using the arrival rate information and the backlight control value 108 of each light source. In the estimation process, the light emission brightness corresponding to the backlight control value is multiplied by the arrival rate for each light source. Subsequently, the total sum of the multiplication values of each light source is calculated as the arrival brightness 210. The arrival rate is a value that represents the amount of light emitted from the light source that arrives at the estimation position, and is the reciprocal of an attenuation rate that represents the amount of light emitted from the light source that is attenuated before the arrival at the estimation position.

Note that the estimation position may not be the central position of the light-emitting area. In addition, the arrival brightness may also be estimated at a plurality of positions in one light-emitting area. For example, the arrival brightness may also be estimated for each pixel.

A correction coefficient calculation unit 211 calculates a correction coefficient 212 used to correct the image data based on the arrival brightness 210. In the present embodiment, since the arrival brightness 210 is estimated for each light-emitting area, the correction coefficient 212 is calculated for each light-emitting area. The correction coefficient 212 is a coefficient used to multiply the pixel value in order to reduce the change of the display brightness caused by a difference between the light emission brightness corresponding to the backlight control value 108 and the arrival brightness 210. In the present embodiment, the correction coefficient 212 is calculated by using the following Expression 3. In Expression 3, Gpn is the correction coefficient 212, Lpn is the arrival brightness 210, and Lt is the light emission brightness corresponding to the backlight control value 108.

$$Gpn=Lt/Lpn \quad \text{(Expression 3)}$$

Note that a correction value that is added to the pixel value may also be calculated instead of the correction coefficient.

The display image data 106 is generated based on the processed base image data 202, the converted difference data 205, and the block Max Ratio 207 by a Ratio correction unit 213 and a pixel value correction unit 203.

The Ratio correction unit 213 generates corrected difference data 214 that corresponds to a difference between the converted difference data 205 and the block Max Ratio 207 based on the converted difference data 205 and the block Max Ratio 207. In the present embodiment, for each pixel, the brightness ratio that corresponds to a difference between the post-conversion brightness ratio of the pixel and the block Max Ratio 207 of the light-emitting area to which the pixel belongs is calculated as a corrected brightness ratio as the brightness ratio represented by the corrected difference data 214. Specifically, the corrected brightness ratio is calculated for each pixel by dividing the post-conversion brightness ratio by the block Max Ratio 207. That is, the corrected brightness ratio is calculated by using the following Expression 4. In Expression 4, Rbn is the post-conversion brightness ratio, Rmn is the block Max Ratio 207, and Abn is the corrected brightness ratio. With this, the corrected difference data 214 is generated. The post-conversion brightness ratio is the brightness ratio represented by the converted difference data 205.

$$Abn=Rbn/Rmn \quad \text{(Expression 4)}$$

Figure 6:
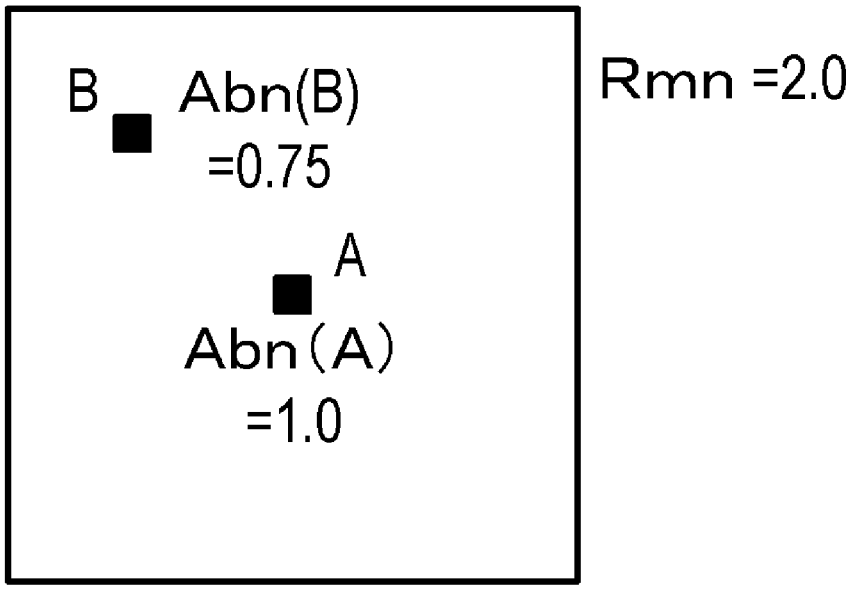
FIG. 6 is a view showing an example of a process of a Ratio correction unit.

A specific example of the process of the Ratio correction unit 213 will be described by using FIG. 6. FIG. 6 shows the same light-emitting area as that of FIG. 4. As described above, the post-conversion brightness ratio Rbn (A) of the pixel A is 2.0 times, and the post-conversion brightness ratio Rbn (B) of the pixel B is 1.5 times. Rmn as the block Max Ratio is the post-conversion brightness ratio Rbn (A)=2.0. Accordingly, the corrected brightness ratio Abn (A) of the pixel A is calculated by the following Expression 5, and the corrected brightness ratio Abn (B) of the pixel B is calculated by the following Expression 6.

$$Abn(A)=Rbn(A)/Rmn=1.0 \quad \text{(Expression 5)}$$

$$Abn(B)=Rbn(B)/Rmn=0.75 \quad \text{(Expression 6)}$$

The pixel value correction unit 203 generates the display image data 106 by performing the brightness range expansion process that uses the corrected difference data 214 on the processed base image data 202. In the present embodiment, by performing the above-described brightness range expansion process and a first correction process that uses the correction coefficient 212 on the processed base image data 202, the display image data 106 is generated. The brightness range expansion process is a process for correcting the gradation value of the image in accordance with the corrected brightness ratio represented by the corrected difference data 214, and the first correction process is a process for multiplying the gradation value of the image data by the correction coefficient 212. For the pixel at the estimation position of the arrival brightness 210, by multiplying a processed pixel value (the pixel value of the processed base image data 202) by the corrected brightness ratio and the correction coefficient 212, a display pixel value (the pixel value of the display image data 106) is calculated. For the pixel at the position other than the estimation position, an interpolation correction coefficient is calculated by an interpolation process that uses the correction coefficient 212. Subsequently, by multiplying the processed pixel value by the corrected brightness ratio and the interpolation correction coefficient (the correction coefficient calculated by the interpolation process), the display pixel value is calculated. However, in the case where the pixel value (the multiplication value) after the execution of the brightness range expansion process and the first correction process is a value outside the range (input range) of the pixel value that can be inputted to the liquid crystal panel 107, the display pixel value is calculated by correcting the multiplication value such that the multiplication value falls within the input range. For example, in the case where the input range of the liquid crystal panel 107 is 8 bits that is the same pixel value as that of the base image data 101, the multiplication value is corrected so as to be not more than 8 bits. In addition, in the case where the input range of the liquid crystal panel 107 is 10 bits that is higher in resolution than the base image data 101, the multiplication value is corrected so as to be not more than 10 bits. By calculating the display pixel value of each pixel, the display image data 106 is generated.

Note that, without calculating the interpolation correction coefficient, the processed pixel value at the position other than the estimation position maybe multiplied by the correction coefficient 212 of the light-emitting area to which the pixel belongs.

Note that, when the display image data 106 is generated, an image process other than the brightness range expansion process and the first correction process may be performed on the processed base image data 202. It is preferable to execute the first correction process from the viewpoint of the image quality, but the first correction process may be omitted. In the case where the first correction process is not performed, the processes in the brightness estimation unit 209 and the correction coefficient calculation unit 211 become unnecessary.

In addition, the order of execution of the processes performed on the processed base image data 202 at the time of the generation of the display image data 106 is not particularly limited. For example, the first correction process may be executed after the execution of the brightness range expansion process, the brightness range expansion process may be executed after the execution of the first correction process, or the brightness range expansion process and the first correction process may be performed simultaneously.

As described above, according to the present embodiment, without restoring the HDR image data, the light emission of the backlight is controlled based on the difference data having the number of bits smaller than that of the HDR image data. Specifically, the light emission brightness of the backlight is controlled based on the brightness difference data. With this, it is possible to control the light emission with the processing load that is smaller than that in the case where the HDR image data is used. That is, according to the present embodiment, it is possible to reduce the processing load and the circuit scale of the display apparatus as compared with the case where the HDR image data is used. In addition, even when the input range of the liquid crystal panel is narrower than the dynamic range of the HDR image data, it is possible to obtain the display image having the wide dynamic range. Specifically, the brightness that cannot be displayed in the case where the light emission of the backlight is made constant can be displayed by controlling the light emission of the backlight, and hence it is possible to obtain the display image having the wide dynamic range and the wide color gamut.

In addition, according to the present embodiment, since the image processing is performed on the image data having the number of bits smaller than that of the HDR image data, it is possible to reduce the processing load and the circuit scale of the functional unit that executes the image processing as compared with the case where the image processing is performed on the HDR image data. Specifically, since the predetermined image process is performed on the base image data 101 in the image processing unit 201, it is possible to reduce the processing load and the circuit scale of the image processing unit 201 as compared with the case where the image processing is performed on the HDR image data. Further, since the brightness range expansion process and the like are performed on the processed base image data 202 in the pixel value correction unit 203, it is possible to reduce the processing load and the circuit scale of the pixel value correction unit 203 as compared with the case where the image processing is performed on the HDR image data.

Furthermore, according to the present embodiment, the brightness difference data 1021 is corrected such that the dynamic range of the image data after the brightness range expansion process that uses the converted difference data 205 matches the dynamic range that can be taken by the display image. With this, it is possible to prevent the light emission brightness based on the difference data from exceeding the maximum value of the light emission brightness that can be taken by the backlight and making the backlight uncontrollable. The brightness difference data 1021 is corrected by using the conversion lookup table in which the post-conversion brightness ratio is set such that the post-conversion brightness ratio does not become constant but increases with respect to the increase of the pre-conversion brightness ratio. With this, it is possible to reduce blown-out highlights of the display image in the area where the light emission brightness based on the brightness difference data 1021 exceeds the maximum value of the light emission brightness that can be taken by the backlight.

Note that the ratio of the gradation value after the brightness range expansion process to the gradation value before the brightness range expansion process is used as the brightness ratio in the present embodiment, but the brightness ratio may also be the ratio of the gradation value before the brightness range expansion process to the gradation value after the brightness range expansion process. In this case, the gradation value before the brightness range expansion process may be appropriately divided by the brightness ratio in the brightness range expansion process. In addition, when the brightness ratio is low, the backlight control value corresponding to the light emission brightness higher than that when the brightness ratio is high may be appropriately generated.

Note that the display apparatus may not have the image processing unit 201. In the pixel value correction unit 203, the base image data 101 may be used instead of the processed base image data 202.

Note that the display apparatus may not have the Ratio range conversion unit 204. The brightness difference data 1021 may be used instead of the converted difference data 205 in the block Max Ratio detection unit 206 and the Ratio correction unit 213. In the case where the dynamic range of the HDR image data as the original image data is not more than the maximum value of the dynamic range that can be taken by the display image, no problems arises even when the brightness difference data 1021 is used without being corrected. Accordingly, in such a case, the process in the Ratio range conversion unit 204 becomes unnecessary.

Second Embodiment

Hereinbelow, a description will be given of a display apparatus and a control method thereof according to a second embodiment of the present invention.

In the first embodiment, the example in which the light emission of the backlight is controlled based only on the difference data has been described. In the present embodiment, an example in which the light emission of the backlight is controlled based on the base image data and the difference data will be described. By controlling the light emission in consideration of the base image data, it is possible to reduce the light emission brightness and the power consumption of the display apparatus as compared with the case where only the difference data is used.

The functional configuration of the display apparatus according to the present embodiment is the same as that in the first embodiment (FIG. 1), and hence the description thereof will be omitted.

Figure 7:
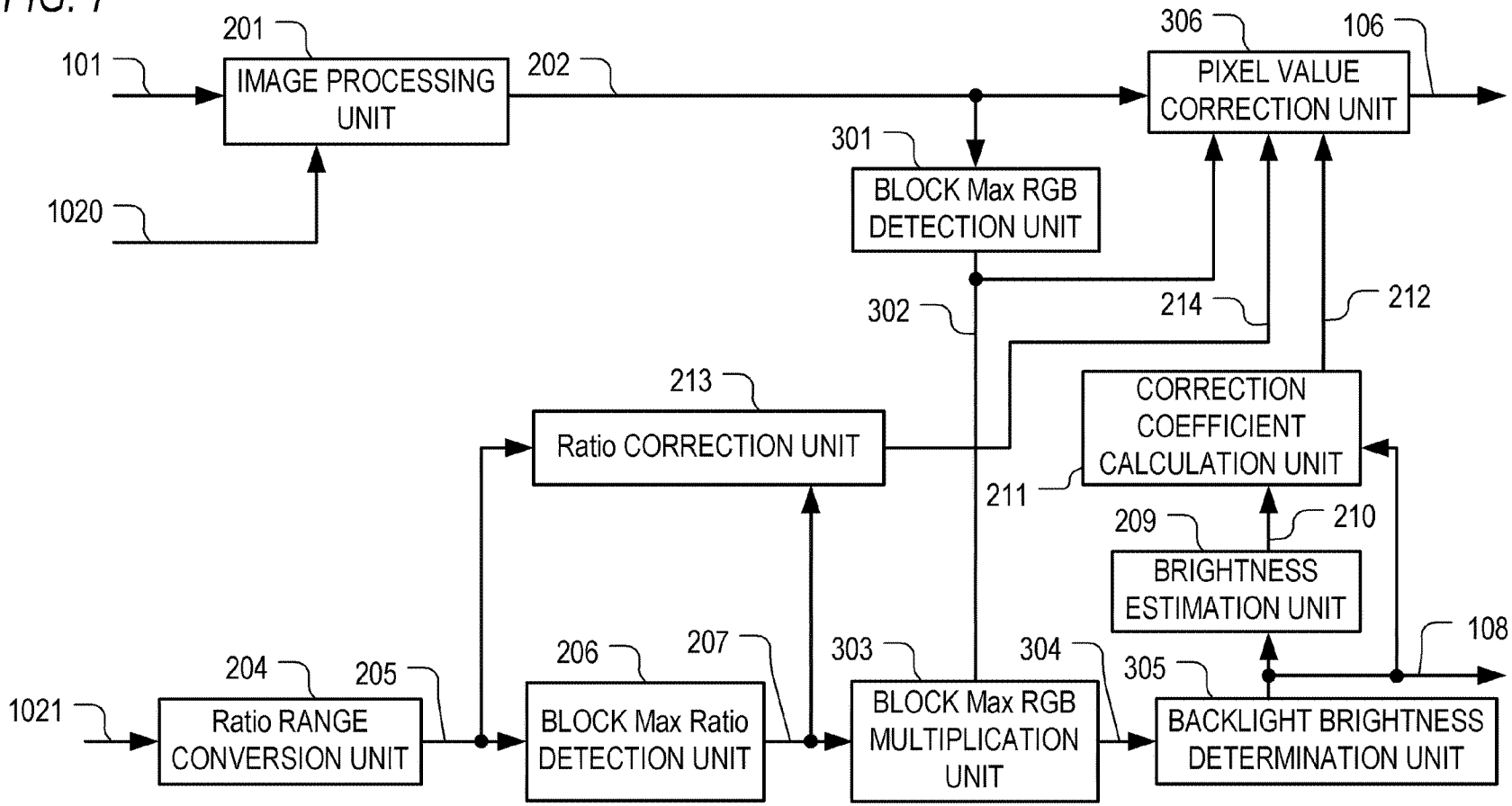
FIG. 7 is a block diagram showing an example of the functional configuration of an HDR processing unit according to a second embodiment.

FIG. 7 is a block diagram showing an example of the functional configuration of an HDR processing unit according to the present embodiment.

Note that, in FIG. 7, the same functional units as those in the first embodiment (FIG. 2) are designated by the same reference numerals, and the description thereof will be omitted.

A block Max RGB detection unit 301 acquires the characteristic value of the processed base image data 202 in the light-emitting area as a second characteristic value. In the present embodiment, the representative value of a processed gradation value (the gradation value of the processed base image data 202) in the light-emitting area is acquired as the second characteristic value. Specifically, from among a plurality of the processed gradation values in the light-emitting area, the processed gradation value having the largest value (block Max RGB 302) is detected as the second characteristic value. In the present embodiment, similarly to the first embodiment, a plurality of the light-emitting areas are present. Accordingly, the second characteristic value is acquired for each light-emitting area.

Note that, as the block Max RGB 302, a maximum R value as the maximum value of the R value may be acquired, a maximum G value as the maximum value of the G value may be acquired, a maximum B value as the maximum value of the B value may be acquired, or a maximum brightness value as the maximum value of the brightness value may be acquired. The maximum value among the maximum R value, the maximum G value, and the maximum B value may also be acquired as the block Max RGB 302.

Note that the second characteristic value is not limited to the block Max RGB 302. For example, the minimum value, the mode, the intermediate value, or the mean value of the processed gradation value may also be acquired as the second characteristic value.

The light emission brightness in the light-emitting area is controlled in accordance with the combination of the block Max Ratio 207 and the block Max RGB 302 by a block Max RGB multiplication unit 303 and a backlight brightness determination unit 305.

The block Max RGB multiplication unit 303 calculates a corrected block Max Ratio 304 by multiplying the block Max Ratio 207 by the ratio of the block Max RGB 302 to the maximum value that can be taken by the block Max RGB 302. That is, by using the following Expression 7, the corrected block Max Ratio 304 is calculated. In Expression 7, PMAX is the maximum value that can be taken by the block Max RGB 302, Rmn is the block Max Ratio 207, Pmn is the block Max RGB 302, and RPmn is the corrected block Max Ratio 304. In the present embodiment, similarly to the first embodiment, the processed base image data is the 8-bit image data. Accordingly, PMAX is 255. In the present embodiment, since a plurality of the light-emitting areas are present, the corrected block Max Ratio 304 is calculated for each light-emitting area.

$$RPmn = Rmn \times Pmn / PMAX \quad \text{(Expression 7)}$$

Note that the determination method of the corrected block Max Ratio 304 is not limited to the above method. For example, the corrected block Max Ratio 304 may also be determined by using information (a function or a table) representing a correspondence between the combination of the block Max Ratio and the block Max RGB and the corrected block Max Ratio.

The backlight brightness determination unit 305 controls the light emission brightness in the light-emitting area in accordance with the corrected block Max Ratio 304. Specifically, the backlight brightness determination unit 305 determines the backlight control value 108 in accordance with the corrected block Max Ratio 304, and outputs the determined backlight control value 108. The determination method of the backlight control value 108 is the same as that in the first embodiment. The corrected block Max Ratio 304 changes depending on the block Max RGB 302, and hence the backlight control value 108 also changes depending on the block Max RGB 302. With this, it is possible to reduce the power consumption. For example, in the case where the block Max RGB 302 is 0, the value corresponding to the light emission brightness 0 is determined as the backlight control value, and hence it is possible to reduce the power consumption.

In the present embodiment, the display image data 106 is generated based on the processed base image data 202, the converted difference data 205, the block Max Ratio 207, and the block Max RGB 302 by the Ratio correction unit 213 and a pixel value correction unit 306. Specifically, the corrected difference data 214 is generated by the same method as that in the first embodiment, and the display image data 106 is generated based on the corrected difference data 214, the block Max Ratio 207, and the block Max RGB 302.

The pixel value correction unit 306 generates the display image data 106 by performing the brightness range expansion process that uses the corrected difference data 214, the first correction process that uses the correction coefficient 212, and a second correction process that uses the block Max RGB 302 on the processed base image data 202. The second correction process is a process for multiplying the gradation value of the image data by the reciprocal of a maximum pixel ratio. The maximum pixel ratio is the ratio of the block Max RGB 302 to the maximum value that can be taken by the block Max RGB 302. For the pixel at the estimation position, the display pixel value is calculated by multiplying the processed pixel value by the corrected brightness ratio, the correction coefficient 212, and the reciprocal of the maximum pixel ratio. For the pixel at the position other than the estimation position, an interpolated maximum pixel ratio is calculated by an interpolation process that uses the maximum pixel ratio. Subsequently, the display pixel value is calculated by multiplying the processed pixel value by the corrected brightness ratio, the interpolation correction coefficient, and the reciprocal of the interpolated maximum pixel ratio. However, in the case where the pixel value (the multiplication value) after the execution of the expansion process, the first correction process, and the second correction process is a value outside the input range of the liquid crystal panel 107, the display pixel value is calculated by correcting the multiplication value such that the multiplication value falls within the input range. The display image data 106 is generated by calculating the display pixel value of each pixel. It is possible to suppress a reduction in display brightness caused by a reduction in the light emission brightness corresponding to the maximum pixel ratio by multiplying the pixel value by the reciprocal of the maximum pixel ratio (or the interpolated maximum pixel ratio).

Note that the processed pixel value of the pixel at the position other than the estimation position may be multiplied by the reciprocal of the maximum pixel ratio of the light-emitting area to which the pixel belongs without calculating the interpolated maximum pixel ratio.

Note that it is preferable to execute the second correction process from the viewpoint of the image quality, but the second correction process may be omitted.

As described above, according to the present embodiment, the light emission of the backlight is controlled based on the difference data and the base image data each having the number of bits smaller than that of the HDR image data without restoring the HDR image data. With this, it is possible to control the light emission with the processing load that is smaller than that in the case where the HDR image data is used. In addition, even when the input range of the liquid crystal panel is narrower than the dynamic range of the HDR image data, it is possible to obtain the display image having the wide dynamic range and the wide color gamut.

In addition, according to the present embodiment, since the light emission of the backlight is controlled in consideration of the base image data, it is possible to reduce the light emission brightness of the backlight and the power consumption of the display apparatus as compared with the case where the base image date is not considered.

Third Embodiment

Hereinbelow, a description will be given of a display apparatus and a control method thereof according to a third embodiment of the present invention.

In the first and second embodiments, the example in which the HDR image data is not restored has been described. In the present embodiment, an example in which the HDR image data is restored will be described.

The functional configuration of the display apparatus according to the present embodiment is the same as that in the first embodiment (FIG. 1), and hence the description thereof will be omitted.

Figure 8:
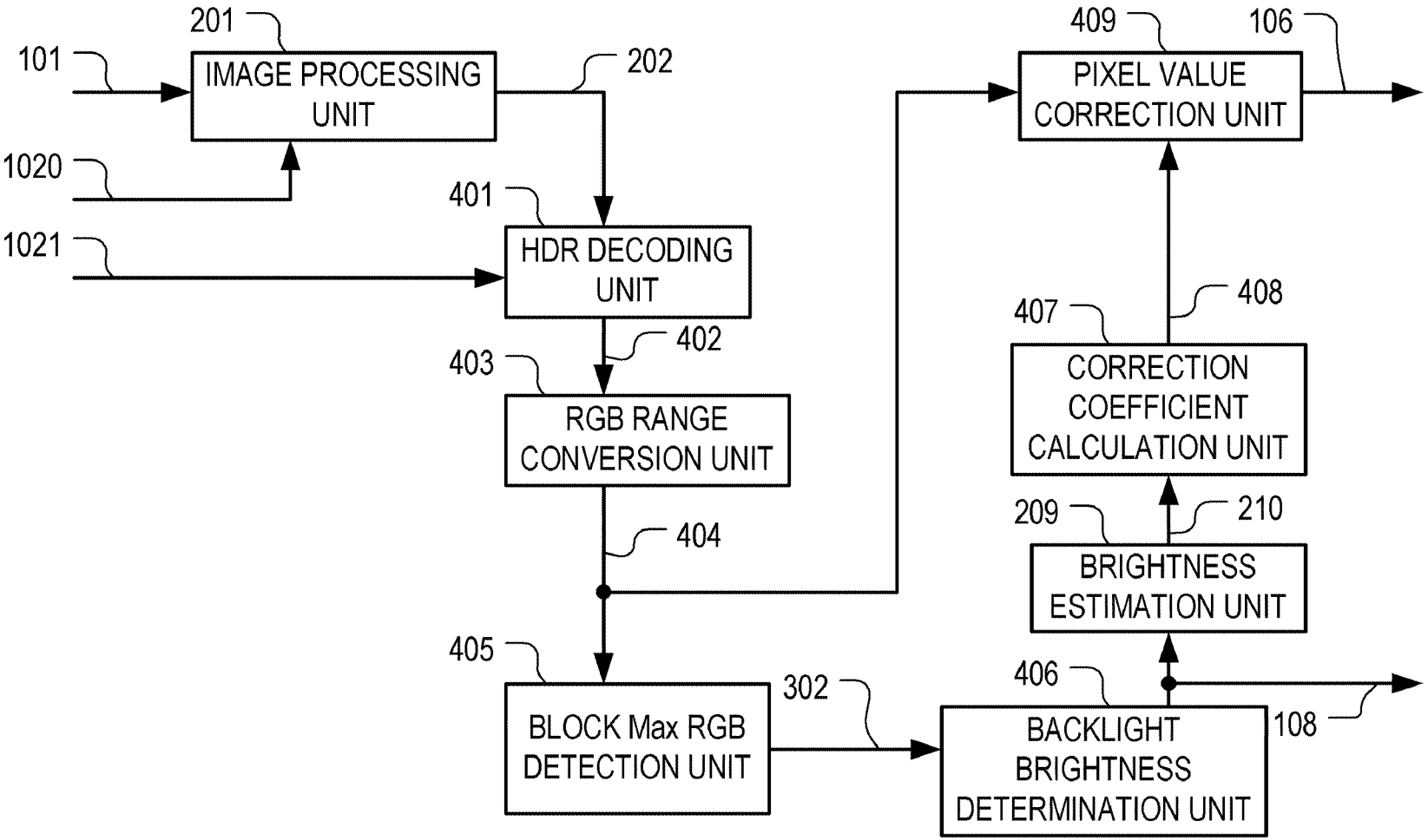
FIG. 8 is a block diagram showing an example of the functional configuration of an HDR processing unit according to a third embodiment.

FIG. 8 is a block diagram showing an example of the functional configuration of an HDR processing unit according to the present embodiment.

Note that, in FIG. 8, the same functional units as those in the first and second embodiments (FIGS. 2 and 7) are designated by the same reference numerals, and the description thereof will be omitted.

An HDR decoding unit 401 generates HDR image data 402 by performing the brightness range expansion process that uses the brightness difference data 1021 on the processed base image data 202. Specifically, the brightness difference data 1021 is brightness ratio data. An HDR pixel value (the pixel value of the HDR image data 402) is calculated by multiplying the gradation value of the processed base image data 202 by the brightness ratio represented by the brightness difference data 1021 for each pixel. With this, the HDR image data 402 is generated. In the present embodiment, the 32-bit HDR image data 402 is generated.

An RGB range conversion unit 403 generates limited HDR image data 404 by reducing the dynamic range of the HDR image data 402 such that the dynamic range of the HDR image data 402 matches the dynamic range that can be taken by the image displayed on the screen. In the present embodiment, the limited HDR image data 404 is generated by converting the gradation value of the HDR image data 402 to the gradation value of the limited HDR image data 404 by using a lookup table that represents a correspondence between the gradation value before the reduction and the gradation value after the reduction.

Figure 9:
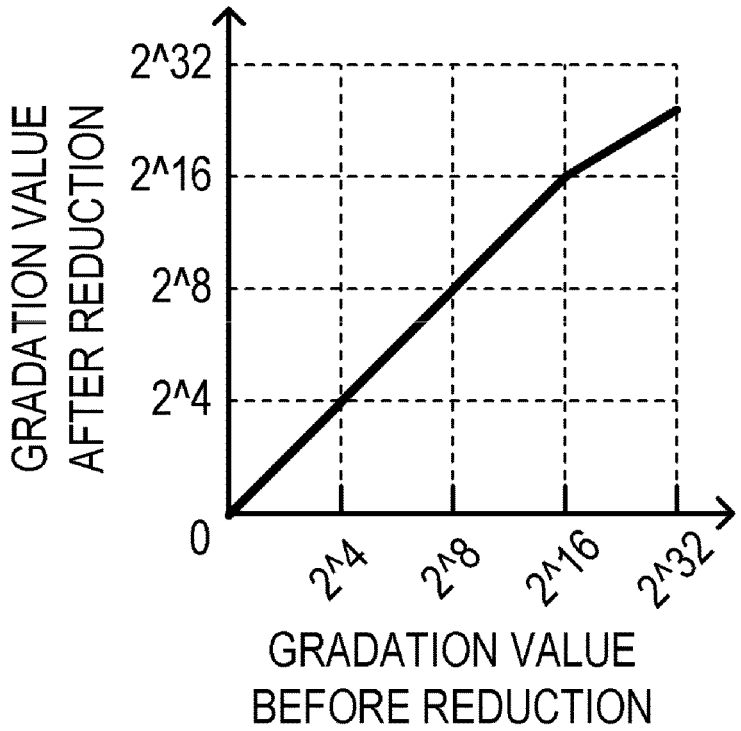
FIG. 9 is a view showing an example of a table for generating a limited HDR image.

FIG. 9 shows an example of the lookup table that is used in the reduction process for generating the limited HDR image data 404. The horizontal axis of FIG. 9 indicates the gradation value before the reduction, and the vertical axis thereof indicates the gradation value after the reduction.

Note that the limited HDR image data 404 may also be generated by calculating the gradation value of the limited HDR image data 404 from the gradation value of the HDR image data 402 by using a function that represents the correspondence between the gradation value before the reduction and the gradation value after the reduction.

The light emission brightness of the backlight 109 is controlled based on the limited HDR image data 404 by a block Max RGB detection unit 405 and a backlight brightness determination unit 406.

The block Max RGB detection unit 405 acquires the characteristic value of the limited HDR image data 404. In the present embodiment, similarly to the second embodiment, the block Max RGB 302 is acquired as the characteristic value. In addition, in the present embodiment, similarly to the second embodiment, a plurality of the light-emitting areas are present. Accordingly, the characteristic value is acquired for each light-emitting area.

The backlight brightness determination unit 406 controls the light emission brightness in the light-emitting area in accordance with the block Max RGB 302. Specifically, the backlight brightness determination unit 406 determines the backlight control value 108 in accordance with the block Max RGB 302, and outputs the determined backlight control value 108. With this, the light emission brightness is controlled. In the present embodiment, the backlight brightness determination unit 406 acquires the light emission brightness corresponding to the block Max RGB 302 from a lookup table that represents a correspondence between the gradation value and the light emission brightness, and determines the backlight control value 108 corresponding to the acquired light emission brightness. In the present embodiment, since a plurality of the light-emitting areas are present, the backlight control value 108 is determined for each light-emitting area. That is, the light emission brightness is controlled for each light-emitting area.

Figure 10:
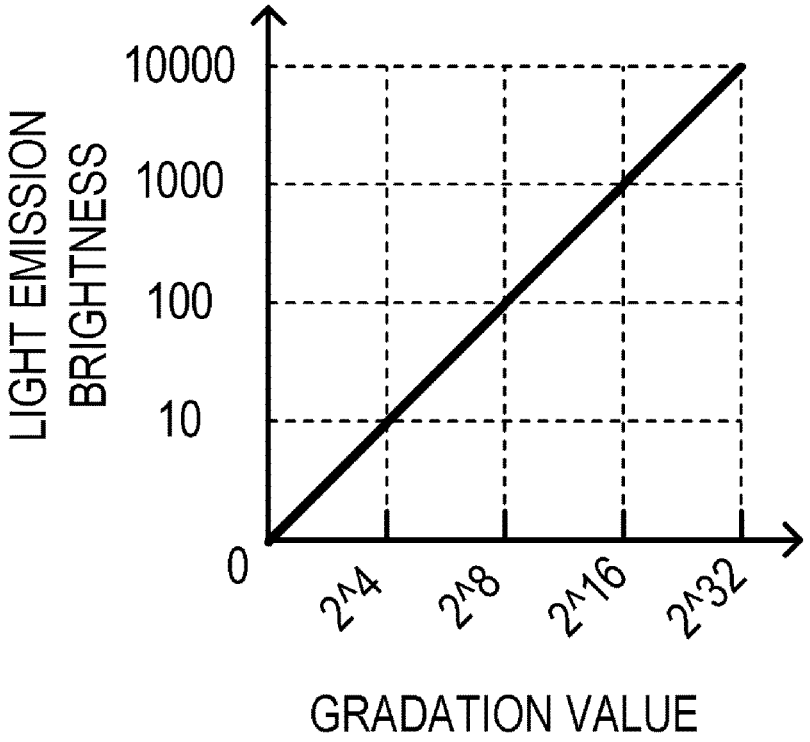
FIG. 10 is a view showing an example of a table for determining the backlight control value.

FIG. 10 shows an example of the lookup table that is used in the determination of the backlight control value 108. The horizontal axis of FIG. 10 indicates the gradation value, and the vertical axis thereof indicates the light emission brightness.

Note that the light emission brightness corresponding to the block Max RGB 302 may be calculated by using a function that represents the correspondence between the gradation value and the light emission brightness and the backlight control value 108 corresponding to the calculated light emission brightness may be determined. The backlight control value 108 corresponding to the block Max RGB 302 may also be acquired by using a table or a function that represents a correspondence between the gradation value and the backlight control value.

A correction coefficient calculation unit 407 calculates the ratio between the light emission based on the limited HDR image data and reference light emission as a correction coefficient 408. Specifically, the ratio between the arrival brightness 210 estimated in the brightness estimation unit 209 and a reference light emission brightness is calculated as the correction coefficient 408. That is, the correction coefficient 408 is calculated by using the following Expression 8. In Expression 8, Lpn is the arrival brightness 210, Lm is the reference light emission brightness, and Gpn is the correction coefficient 408. In the present embodiment, the upper limit value of the light emission brightness is used as the reference light emission brightness. Specifically, 5000 $cd/m^2$ is used as the reference light emission brightness. Unlike the correction coefficient 212 in each of the first and second embodiments, the correction coefficient 408 is a coefficient used to multiply the pixel value in order to reduce the change of the display brightness caused by the change of the light emission brightness from the reference value. In the present embodiment, the arrival brightness 210 is estimated for each light-emitting area, and hence the correction coefficient 408 is calculated for each light-emitting area.

$$Gpn=Lm/Lpn \quad \text{(Expression 8)}$$

Note that the reference light emission brightness is not limited to the upper limit value of the light emission brightness. The reference light emission brightness may be lower than the upper limit value of the light emission brightness.

Note that the light emission brightness corresponding to the backlight control value 108 may be used as Lm without estimating the arrival brightness 210. In addition, the arrival brightness in the case where all of the light sources are caused to emit light at the reference light emission brightness may be used as Lpn.

Note that a value obtained by subtracting one of the light emission brightness based on the limited HDR image and the reference light emission brightness from the other one thereof may be calculated instead of the correction coefficient 408. Any value may be calculated as long as the value represents the difference between the light emission based on the limited HDR image and the reference light emission.

A pixel value correction unit 409 generates the display image data 106 by correcting the gradation value of the limited HDR image data 404 based on the correction coefficient 408. Specifically, for the pixel at the estimation position of the arrival brightness 210, the display pixel value is calculated by multiplying a limited pixel value (the pixel value of the limited HDR image data 404) by the correction coefficient 408. For the pixel at the position other than the estimation position, an interpolation correction coefficient is calculated by an interpolation process that uses the correction coefficient 408. Subsequently, the display pixel value is calculated by multiplying the limited pixel value by the interpolation correction coefficient. However, in the case where the pixel value (the multiplication value) after the execution of the correction process based on the correction coefficient 408 is a value outside the input range of the liquid crystal panel 107, the display pixel value is calculated by correcting the multiplication value such that the multiplication value falls within the input range. For example, in the case where the input range of the liquid crystal panel 107 is 8 bits, the multiplication value is corrected to the 8-bit value by converting the multiplication value to the 32-bit value and then dropping the lower 24 bits of the value after the conversion. In the case where the input range of the liquid crystal panel 107 is 10 bits, the multiplication value is corrected to a 10-bit value by converting the multiplication value to the 32-bit value and then dropping the lower 22 bits of the value after the conversion. The display image data 106 is generated by calculating the display pixel value of each pixel.

As described above, according to the present embodiment, the limited HDR image data is generated by restoring the HDR image data and then reducing the dynamic range (the number of bits) of the HDR image data. The light emission of the backlight is controlled based on the limited HDR image data. With this, it is possible to control the light emission with the processing load that is smaller than that in the case where the HDR image data is used. That is, according to the present embodiment, it is possible to reduce the processing load and the circuit scale of the display apparatus as compared with the case where the HDR image data is used. In addition, even when the input range of the liquid crystal panel is narrower than the dynamic range of the HDR image data, it is possible to obtain the display image having the wide dynamic range and the wide color gamut.

In addition, by using the limited HDR image data, it is possible to prevent the light emission brightness based on the HDR image data from exceeding the maximum value of the light emission brightness that can be taken by the backlight and making the backlight uncontrollable. The limited HDR image data is generated by using the lookup table in which the gradation value after the reduction is set such that the gradation value after the reduction does not become constant but increases with respect to the increase of the gradation value before the reduction. With this, it is possible to reduce blown-out highlights of the display image in the area where the light emission brightness based on the HDR image data exceeds the maximum value of the light emission brightness that can be taken by the backlight.

Further, by using the limited HDR image data, it is possible to reduce the light emission brightness of the backlight and the power consumption of the display apparatus as compared with the case where only the difference data is used.

Fourth Embodiment

Hereinbelow, a description will be given of a display apparatus and a control method thereof according to a fourth embodiment of the present invention.

In the present embodiment, another example in which the HDR image data is restored will be described.

The functional configuration of the display apparatus according to the present embodiment is the same as that in the first embodiment (FIG. 1), and hence the description thereof will be omitted.

Figure 11:
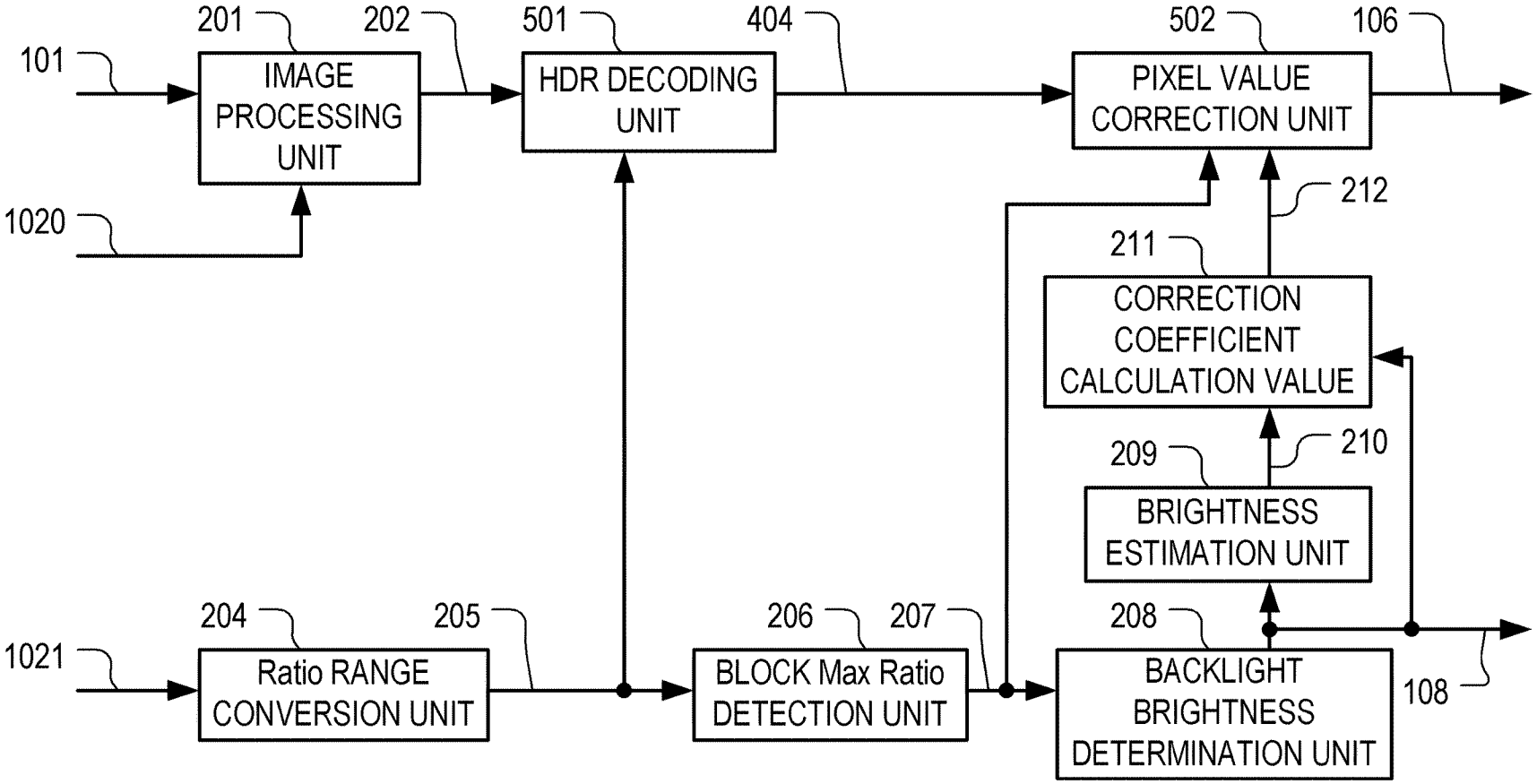
FIG. 11 is a block diagram showing an example of the functional configuration of an HDR processing unit according to a fourth embodiment.

FIG. 11 is a block diagram showing an example of the functional configuration of an HDR processing unit according to the present embodiment.

Note that, in FIG. 11, the same functional units as those in the first to third embodiments (FIGS. 2, 7, and 8) are designated by the same reference numerals, and the description thereof will be omitted.

An HDR decoding unit 501 generates the limited HDR image data 404 (expanded image data) by performing the brightness range expansion process that uses the converted difference data 205 on the processed base image data 202. The method of the brightness range expansion process is the same as that in the third embodiment.

Note that, similarly to the HDR decoding unit 401 in the third embodiment, the HDR image data 402 may be generated as an expanded image by performing the brightness range expansion process that uses the brightness difference data 1021.

A pixel value correction unit 502 generate the display image data 106 based on the block Max Ratio 207 and the limited HDR image data 404. Specifically, reduced image data obtained by reducing the dynamic range of the limited HDR image data 404 correspondingly to the block Max Ratio 207 is generated as the display image data 106. In the present embodiment, the display image data 106 is generated by performing a reduction process for reducing the dynamic range of the image data based on the block Max Ratio 207 and the first correction process on the limited HDR image data 404. In addition, in the present embodiment, the reduction process is a process for multiplying the gradation value of the image data by the reciprocal of the block Max Ratio 207.

Note that, in the case where the pixel value (the multiplication value) after the execution of the reduction process and the first correction process is a value outside the input range of the liquid crystal panel 107, the display pixel value is calculated by correcting the multiplication value such that the multiplication value falls within the input range.

As described above, according to the present embodiment, similarly to the first to third embodiments, the light emission of the backlight is controlled without using the HDR image data. With this, it is possible to control the light emission with the processing load that is smaller than that in the case where the HDR image data is used. That is, according to the present embodiment, it is possible to reduce the processing load and the circuit scale of the display apparatus as compared with the case where the HDR image data is used. In addition, even when the input range of the liquid crystal panel is narrower than the dynamic range of the HDR image data, it is possible to obtain the display image having the wide dynamic range and the wide color gamut.

Fifth Embodiment

Hereinbelow, a description will be given of a display apparatus and a control method thereof according to a fifth embodiment of the present invention.

In each of the first to fourth embodiments, the example in which the brightness difference data is the brightness ratio data has been described. In the present embodiment, an example in which the brightness difference data is a tone map will be described. The tone map is information (a table or a function) that represents a correspondence between the gradation value before the brightness range expansion process and the gradation value after the brightness range expansion process. The tone map as the brightness difference data is obtained by interchanging the input value and the output value of the tone map that is used in a conversion process for converting the HDR image data to the base image data, and hence the tone map can be called an inverse tone map.

A relationship among the pixel value of the HDR image data corresponding to the original image data, the pixel value of the base image data, the value of the color difference data, and the inverse tone map is represented by the following Expression 9. In Expression 9, (Ro, Go, Bo) is the pixel value of the HDR image data, and (R, G, B) is the pixel value of the base image data. $T^{-1}$ is the inverse tone map, and (ResR, ResG, ResB) is the value of the color difference data. In a method that uses the inverse tone map as the brightness difference data, in general, residual data that represents a residual value in the same form as that of the pixel value is used as the color difference data. ResR is an R value (residual R value) represented by the color difference data, ResG is a G value (residual G value) represented by the color difference data, and ResB is a B value (residual B value) represented by the color difference data. Normally, one inverse tone map $T^{-1}$ and the residual values (ResR, ResG, ResB) of each pixel are prepared for one image data item.

[Expression3]

$$\begin{pmatrix} Ro \\ Go \\ Bo \end{pmatrix} = T^{-1}\begin{pmatrix} R \\ G \\ B \end{pmatrix} + \begin{pmatrix} ResR \\ ResG \\ ResB \end{pmatrix} \quad \text{(Expression 9)}$$

Note that, although Expression 9 is Expression in the case where the inverse tone map is data for expanding the dynamic range of the base image data, the inverse tone map may be data for expanding the dynamic range of the image data after the color gamut expansion process.

In the present embodiment, it is assumed that the R value, the G value, and the B value of the HDR image data as the original image date are expressed in the form of a 32-bit floating point. In addition, it is assumed that the R value, the G value, and the B value of the base image data are expressed in the form of an 8-bit floating point, and the residual R value, the residual G value, and the residual B value of the color difference data are expressed in the form of the 8-bit floating point. Further, it is assumed that the inverse tone map is a lookup table in which the 8-bit value is inputted and the 32-bit value is outputted. The input value and the output value of the inverse tone map have, e.g., a correspondence shown in FIG. 12.

The functional configuration of the display apparatus according to the present embodiment is the same as that in the first embodiment (FIG. 1), and hence the description thereof will be omitted.

Figure 13:
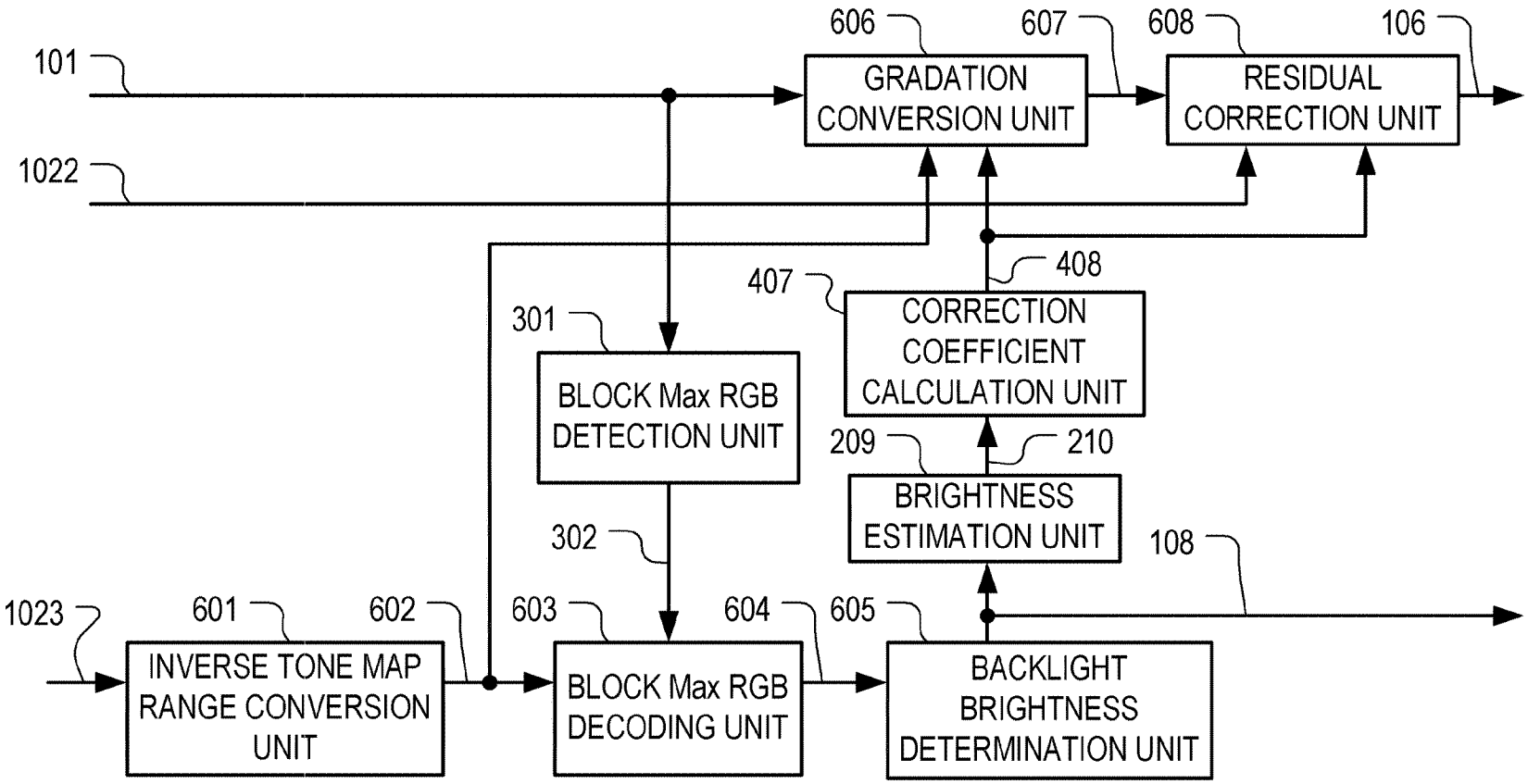
FIG. 13 is a block diagram showing an example of the functional configuration of an HDR processing unit according to a fifth embodiment.

FIG. 13 is a block diagram showing an example of the functional configuration of an HDR processing unit according to the present embodiment.

Note that, in FIG. 13, the same functional units as those in the first to fourth embodiments (FIGS. 2, 7, 8, and 11) are designated by the same reference numerals, and the description thereof will be omitted.

An inverse tone map 1023 is inputted to the HDR processing unit according to the present embodiment as the brightness difference data.

Note that one inverse tone map 1023 that is common to pixels may be inputted or the inverse tone map 1023 for each pixel may also be inputted. In addition, the inverse tone map 1023 for each area may also be inputted.

An inverse tone map range conversion unit 601 acquires the inverse tone map 1023 (first difference data). Subsequently, the inverse tone map range conversion unit 601 corrects the inverse tone map 1023. With this, a converted inverse tone map 602 (second difference data) that is smaller in the expansion degree of the dynamic range than the inverse tone map 1023 is generated. Specifically, the inverse tone map range conversion unit 601 corrects the inverse tone map 1023 such that the dynamic range of the image data after the brightness range expansion process that uses the converted inverse tone map 602 matches the dynamic range that can be taken by the display image. In the present embodiment, the inverse tone map 1023 is corrected such that the dynamic range of the image data after the brightness range expansion process that uses the converted inverse tone map 602 matches the maximum value of the dynamic range that can be taken by the display image.

In the present embodiment, the converted inverse tone map 602 is generated by correcting the output value represented by the inverse tone map 1023. Specifically, the output value represented by the inverse tone map 1023 is converted to the output value represented by the converted inverse tone map 602 by using a conversion lookup table. The conversion lookup table represents a correspondence between a pre-conversion output value as the output value before the conversion (before the correction) and a post-conversion output value as the output value after the conversion.

Figure 12:
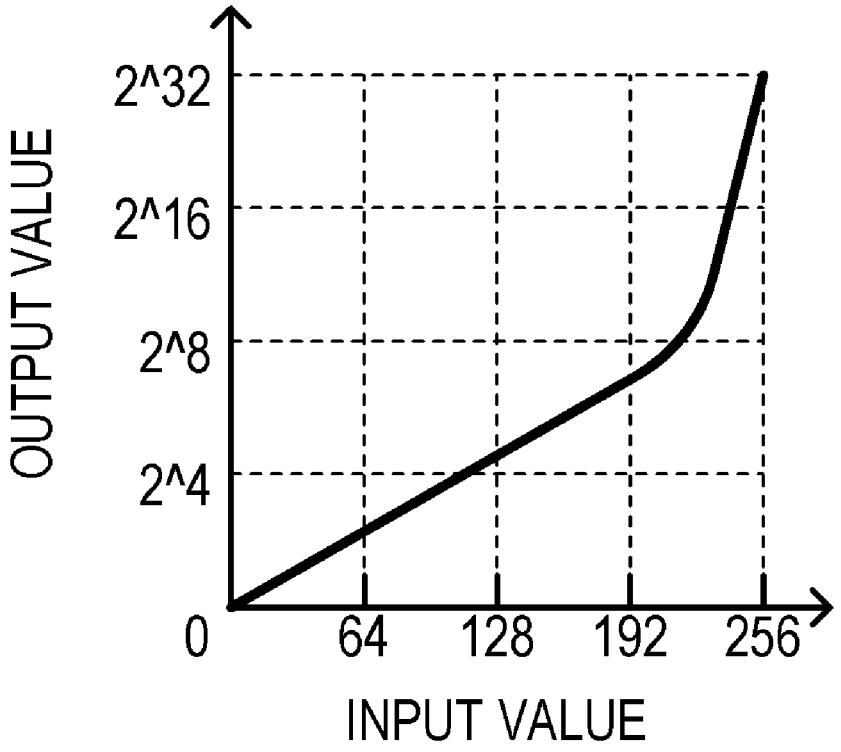
FIG. 12 is a view showing an example of an inverse tone map.
Figure 14:
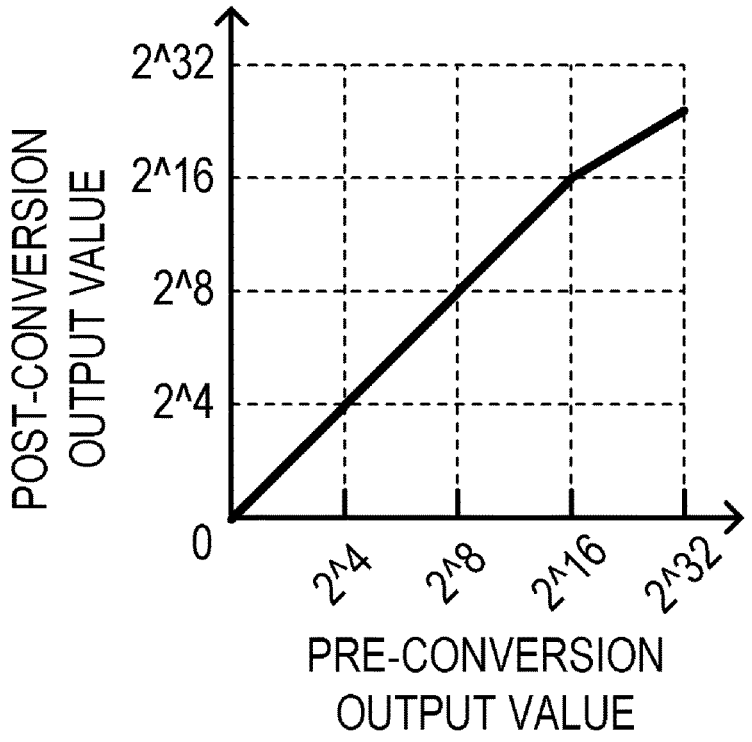
FIG. 14 is a view showing an example of a table for correcting the output value of the inverse tone map.
Figure 15:
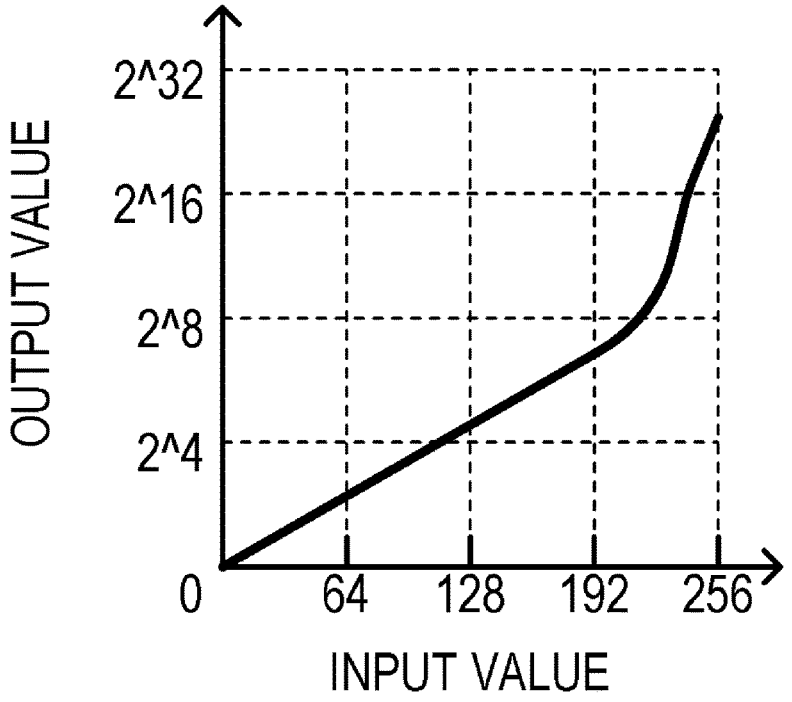
FIG. 15 is a view showing an example of a converted inverse tone map.

FIG. 14 shows an example of the conversion lookup table. The horizontal axis of FIG. 14 indicates the pre-conversion output value, and the vertical axis thereof indicates the post-conversion output value. When the output value represented by the inverse tone map shown in FIG. 12 is converted by using the conversion lookup table shown in FIG. 14, the inverse tone map shown in FIG. 15 is obtained as the converted inverse tone map 602.

Note that the output value represented by the inverse tone map 1023 may be converted to the output value represented by the converted inverse tone map 602 by using a function that represents the correspondence between the pre-conversion output value and the post-conversion output value. That is, the output value represented by the converted inverse tone map 602 may be calculated by using the function.

Note that, in the present embodiment, the description has been given of the example in which the inverse tone map 1023 is corrected such that the dynamic range of the image data after the brightness range expansion process that uses the converted inverse tone map 602 matches the maximum value of the dynamic range that can be taken by the display image, but the present invention is not limited thereto. It is only necessary for the dynamic range of the image data after the brightness range expansion process that uses the converted inverse tone map 602 to match the dynamic range that can be taken by the display image. The dynamic range of the image data after the brightness range expansion process that uses the converted inverse tone map 602 may match a value lower than the maximum value of the dynamic range that can be taken by the display image.

A block Max RGB decoding unit 603 acquires a third characteristic value based on the converted inverse tone map 602 and the block Max RGB 302. The third characteristic value is the characteristic value of the image data in the light-emitting area and is also the characteristic value after the brightness range expansion process that uses the converted inverse tone map 602. The block Max RGB decoding unit 603 acquires a limited output value corresponding to the block Max RGB 302 from the converted inverse tone map 602 as a decoded block Max RGB 604 serving as the third characteristic value. In the present embodiment, similarly to the first embodiment, a plurality of the light-emitting areas are present. Accordingly, the third characteristic value is acquired for each light-emitting area.

A backlight brightness determination unit 605 controls the light emission brightness in the light-emitting area in accordance with the decoded block Max RGB 604. Specifically, the backlight brightness determination unit 605 determines the backlight control value 108 in accordance with the decoded block Max RGB 604, and outputs the determined backlight control value 108. The determination method of the backlight control value 108 is the same as that in the third embodiment.

The display image data 106 is generated based on the base image data 101, the converted inverse tone map 602, and the correction coefficient 408 by a gradation conversion unit 606 and a residual correction unit 608.

Note that a value obtained by subtracting one of the light emission corresponding to the decoded block Max RGB 604 and the reference light emission from the other one thereof may be calculated instead of the correction coefficient 408. Any value may be used as long as the value represents the difference between the light emission corresponding to the decoded block Max RGB 604 and the reference light emission.

The gradation conversion unit 606 generates processed base image data 607 by performing a brightness range expansion process that uses the converted inverse tone map 602 and the correction process based on the correction coefficient 408 on the base image data 101. The brightness range expansion process is a process for converting the gradation value of the image data according to conversion characteristics of the converted inverse tone map 602. The method of the correction process based on the correction coefficient 408 is the same as that in the third embodiment. In the present embodiment, the correction process is performed after the expansion process is performed.

There are cases where the pixel value after the execution of the brightness range expansion process and the correction process is a value outside the input range of the liquid crystal panel 107. In these cases, the pixel value of the processed base image data 607 may be calculated by correcting the pixel value after the execution of the brightness range expansion process and the correction process such that the pixel value falls within the input range.

Note that the brightness range expansion process may also be performed after the correction process.

Note that the image processing other than the brightness range expansion process and the correction process may be executed in the gradation conversion unit 606. For example, the luminosity adjustment process, the contract adjustment process, the chroma adjustment process, and the sharpness adjustment process may be executed. The dynamic range of the image data after the brightness range expansion process is considered to be wider than that of the image data before the brightness range expansion process. Accordingly, the luminosity adjustment process, the contract adjustment process, the chroma adjustment process, and the sharpness adjustment process are preferably executed before the brightness range expansion process from the viewpoint of the processing load.

A residual correction unit 608 generates the display image data 106 by performing a residual correction process as the color gamut expansion process based on color difference data 1022 (residual data) and the correction process based on the correction coefficient 408 on the processed base image data 607. In the present embodiment, the display pixel value is calculated by using the following Expression 10. In Expression 10, (R607, G607, B607) is the pixel value of the processed base image data 607, and (ResR, ResG, ResB) is the value of the residual data 1022. Gpn is the correction coefficient 408, and (R106, G106, B106) is the display pixel value.

[Expression 4]

$$\begin{pmatrix} R106 \\ G106 \\ B106 \end{pmatrix} = \begin{pmatrix} R607 \\ G607 \\ B607 \end{pmatrix} + \begin{pmatrix} ResR \\ ResG \\ ResB \end{pmatrix} \times Gpn \qquad \text{(Expression 10)}$$

Note that, in the case where the pixel value after the execution of the residual correction process is a value outside the input range of the liquid crystal panel 107, the display pixel value is preferably calculated by correcting the pixel value after the execution of the residual correction process such that the pixel value falls within the input range.

As described above, according to the present embodiment, the inverse tone map is used as the brightness difference data, and the light emission of the backlight is controlled based on the difference data and the base image data each having the number of bits smaller than that of the HDR image data without restoring the HDR image data. With this, it is possible to control the light emission with the processing load that is smaller than that in the case where the HDR image data is used. In addition, even when the input range of the liquid crystal panel is narrower than the dynamic range of the HDR image data, it is possible to obtain the display image having the wide dynamic range and the wide color gamut.

Further, according to the present embodiment, since the light emission of the backlight is controlled in consideration of the base image data, it is possible to reduce the light emission brightness of the backlight and the power consumption of the display apparatus as compared with the case where the base image data is not considered.

Note that the display apparatus may not have the inverse tone map range conversion unit 601. The inverse tone map

1023 may be used instead of the converted inverse tone map 602 in the block Max RGB decoding unit 603 and the gradation conversion unit 606. In the case where the dynamic range of the HDR image data as the original image data is not more than the maximum value of the dynamic range that can be taken by the display image, no problem arises even when the inverse tone map 1023 is used without being corrected. Accordingly, in such a case, the process in the inverse tone map range conversion unit 601 becomes unnecessary.

Note that, in each of the first to fourth embodiments, the example in which the brightness difference data is the brightness ratio data has been described, but the difference data different from the brightness ratio data may be used in the configuration of each of the first to fourth embodiments. For example, as the brightness difference data, gradation difference data representing a difference value that is added to or subtracted from the gradation value for each pixel may be used or the tone map may also be used.

In addition, in the fifth embodiment, the example in which the brightness difference data is the tone map has been described, but the brightness difference data different from the tone map may be used in the configuration of the fifth embodiment. For example, as the brightness difference data, the gradation difference data or the brightness ratio data may be used.

Note that, in each of the first to fifth embodiments, the example in which the light emission brightness of the backlight is controlled by using the brightness difference data has been described, but the present invention is not limited thereto. For example, the light emission color of the backlight may be controlled by using the color difference data. In addition, the light emission brightness and the light emission color of the backlight may be controlled by using the brightness difference data and the color difference data.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-014516, filed on Jan. 29, 2014, which is hereby incorporated by reference herein in its entirety.

What is claimed is:

1. A display apparatus comprising:

a light emission unit;

a display unit configured to display an image on a screen by modulating light from the light emission unit;

an acquisition unit configured to acquire base image data and difference data used in an expansion process for expanding at least one of a dynamic range and a color gamut of image data;

a control unit configured to control light emission of the light emission unit, based on the difference data; and a generation unit configured to generate display image data outputted to the display unit, based on the base image data.

2. The display apparatus according to claim 1, wherein the difference data includes brightness difference data used in a brightness range expansion process for expanding the dynamic range of the image data, and the control unit controls a light emission brightness of the light emission unit, based on the brightness difference data.

3. The display apparatus according to claim 1, wherein the difference data includes color difference data used in a color gamut expansion process for expanding the color gamut of the image data, and the control unit controls a light emission color of the light emission unit, based on the color difference data.

4. The display apparatus according to claim 1, wherein the light emission unit is configured to be capable of controlling the light emission on a basis of units of light-emitting areas each constituted of a plurality of pixels, the control unit acquires a characteristic value of the difference data in the light-emitting area as a first characteristic value and controls the light emission in the light-emitting area, based on the first characteristic value, and the generation unit generates the display image data, based on the base image data, the difference data, and the first characteristic value.

5. The display apparatus according to claim 4, wherein the generation unit generates corrected difference data corresponding to a difference between the difference data and the first characteristic value, based on the difference data and the first characteristic value, and generates the display image data by performing an expansion process using the corrected difference data on the base image data.

6. The display apparatus according to claim 5, wherein the difference data includes brightness ratio data representing, for each pixel, a brightness ratio as a ratio between a gradation value before the expansion process and a gradation value after the expansion process, the first characteristic value is a representative value of the brightness ratio represented by the brightness ratio data in the light-emitting area, and the generation unit generates the corrected difference data by dividing the brightness ratio represented by the brightness ratio data by the first characteristic value.

7. The display apparatus according to claim 4, wherein the generation unit generates expanded image data by performing the expansion process using the difference data on the base image data, and, based on the first characteristic value and the expanded image data, generates, as the display image data, reduced image data obtained by reducing at least one of a dynamic range and a color gamut of the expanded image data correspondingly to the first characteristic value.

8. The display apparatus according to claim 7, wherein the difference data includes brightness ratio data representing, for each pixel, a brightness ratio as a ratio between a gradation value before the expansion process and a gradation value after the expansion process, the first characteristic value is a representative value of the brightness ratio represented by the brightness ratio data in the light-emitting are, and the generation unit generates the reduced image data by multiplying a gradation value of the expanded image data by a reciprocal of the first characteristic value.

9. The display apparatus according to claim 1, wherein the light emission unit is configured to be capable of controlling the light emission on a basis of units of light-emitting areas each constituted of a plurality of pixels, and the control unit acquires a characteristic value of the difference data in the light-emitting area as a first characteristic value, acquires a characteristic value of the base image data in the light-emitting area as a second characteristic value, and controls the light emission in the light-emitting area in accordance with a combination of the first characteristic value and the second characteristic value, and the generation unit generates the display image data, based on the base image data, the difference data, the first characteristic value, and the second characteristic value.

10. The display apparatus according to claim 9, wherein the generation unit generates corrected difference data corresponding to a difference between the difference data and the first characteristic value, based on the difference data and the first characteristic value, and generates the display image data, based on the base image data, the corrected difference data, and the second characteristic value.

11. The display apparatus according to claim 10, wherein the difference data includes brightness ratio data representing, for each pixel, a brightness ratio as a ratio between a gradation value before the expansion process and a gradation value after the expansion process, the first characteristic value is a representative value of the brightness ratio represented by the brightness ratio data in the light-emitting area, the second characteristic value is a representative value of a gradation value of the base image data in the light-emitting area, and the generation unit generates the corrected difference data by dividing the brightness ratio represented by the brightness ratio data by the first characteristic value, and generates the display image data by performing both a process for correcting a gradation value of the image data in accordance with a brightness ratio represented by the corrected difference data and a process for multiplying the gradation value of the image data by a reciprocal of a ratio of the second characteristic value to a maximum value that can be taken by the second characteristic value on the base image data.

12. The display apparatus according to claim 9, wherein the difference data includes brightness ratio data representing, for each pixel, a brightness ratio as a ratio between a gradation value before the expansion process and a gradation value after the expansion process, the first characteristic value is a representative value of the brightness ratio represented by the brightness ratio data in the light-emitting area, the second characteristic value is a representative value of a gradation value of the base image data in the light-emitting area, and the control unit controls a light emission brightness in the light-emitting area in accordance with a value obtained by multiplying the first characteristic value by a ratio of the second characteristic value to a maximum value that can be taken by the second characteristic value.

13. The display apparatus according to claim 1, wherein the light emission unit is configured to be capable of controlling the light emission on the basis of units of light-emitting areas each constituted of a plurality of pixels, and the control unit acquires a characteristic value of the base image data in the light-emitting area as a second characteristic value, acquires a third characteristic value that is a characteristic value of the image data in the light-emitting area and is also a characteristic value after the expansion process using the difference data, based on the difference data and the second characteristic value, and controls the light emission in the light-emitting area in accordance with the third characteristic value, and the generation unit generates the display image data, based on the base image data, the difference data, and a difference between the light emission corresponding to the third characteristic value and reference light emission.

14. The display apparatus according to claim 13, wherein the generation unit generates the display image data by performing both the expansion process using the difference data and a process for correcting a gradation value of the image data based on the difference between the light emission corresponding to the third characteristic value and the reference light emission on the base image data.

15. The display apparatus according to claim 13, wherein the difference data includes a tone map representing a correspondence between a gradation value before the expansion process and a gradation value after the expansion process, the second characteristic value is a representative value of a gradation value of the base image data in the light-emitting area, and the control unit acquires the gradation value after the expansion process that corresponds to the second characteristic value from the difference data as the third characteristic value.

16. The display apparatus according to claim 1, wherein the acquisition unit generates second difference data smaller in an expansion degree of the expansion process than first difference data as the difference data by correcting the first difference data inputted to the display apparatus.

17. The display apparatus according to claim 16, wherein the expansion process includes a brightness range expansion process for expanding the dynamic range of the image data, and the acquisition unit corrects the first difference data such that the dynamic range of the image data after an expansion process using the second difference data matches a dynamic range that can be taken by the image displayed on the screen.

18. A display apparatus comprising:

a light emission unit;

a display unit configured to display an image on a screen by modulating light from the light emission unit;

an acquisition unit configured to acquire base image data and difference data used in an expansion process for expanding at least one of a dynamic range and a color gamut of image data;

an expansion unit configured to generate HDR image data by performing the expansion process using the difference data on the base image data;

a reduction unit configured to generate limited HDR image data by reducing a dynamic range of the HDR image data such that the dynamic range of the HDR image data matches a dynamic range that can be taken by the image displayed on the screen;

a control unit configured to control light emission of the light emission unit, based on the limited HDR image data; and a correction unit configured to generate display image data outputted to the display unit by correcting a gradation value of the limited HDR image data, based on a difference between the light emission based on the limited HDR image data and reference light emission.

19. The display apparatus according to claim 1, wherein the light emission unit is configured to be capable of individually controlling the light emission of a plurality of light-emitting areas constituting an area of the screen, and the control unit controls the light emission for each light-emitting area.

20. The display apparatus according to claim 1, wherein the acquisition unit generates second base image data as the base image data by performing a predetermined image process on first base image data inputted to the display apparatus.

21. The display apparatus according to claim 1, wherein the acquisition unit acquires the base image data and the difference data for each frame, and the control unit performs a process for controlling the light emission of the light emission unit for a first frame of still image data and each frame of moving image data, and omits the process for controlling the light emission of the light emission unit for second and subsequent frames of the still image data.

22. A control method of a display apparatus having light emission unit and display unit configured to display an image on a screen by modulating light from the light emission unit, the method comprising:

acquiring base image data and difference data used in an expansion process for expanding at least one of a dynamic range and a color gamut of image data;

controlling light emission of the light emission unit based on the difference data; and generating display image data outputted to the display unit based on the base image data.

23. A control method of a display apparatus having light emission unit and display unit configured to display an image on a screen by modulating light from the light emission unit, the method comprising:

acquiring base image data and difference data used in an expansion process for expanding at least one of a dynamic range and a color gamut of image data;

generating HDR image data by performing the expansion process using the difference data on the base image data;

generating limited HDR image data by reducing a dynamic range of the HDR image data such that the dynamic range of the HDR image data matches a dynamic range that can be taken by the image displayed on the screen;

controlling light emission of the light emission unit based on the limited HDR image data; and generating display image data outputted to the display unit by correcting a gradation value of the limited HDR image data, based on a difference between the light emission based on the limited HDR image data and reference light emission.

24. A non-transitory computer readable medium that stores a program, wherein the program causes a computer to execute the method according to claim 22.

25. A non-transitory computer readable medium that stores a program, wherein the program causes a computer to execute the method according to claim 23.

* * * * *